US011519410B2

(12) United States Patent
Hu et al.

(10) Patent No.: US 11,519,410 B2
(45) Date of Patent: Dec. 6, 2022

(54) VARIABLE-CAPACITY CONTROL STRUCTURE, COMPRESSOR AND VARIABLE-CAPACITY CONTROL METHOD THEREOF

(71) Applicant: GREEN REFRIGERATION EQUIPMENT ENGINEERING RESEARCH CENTER OF ZHUHAI GREE CO., LTD., Zhuhai (CN)

(72) Inventors: Yanjun Hu, Zhuhai (CN); Peizhen Que, Zhuhai (CN); Ouxiang Yang, Zhuhai (CN); Yuanbin Zhai, Zhuhai (CN); Liu Xiang, Zhuhai (CN)

(73) Assignee: GREEN REFRIGERATION EQUIPMENT ENGINEERING RESEARCH CENTER OF ZHUHAI GREE CO., LTD., Zhuhai (CN)

( * ) Notice: Subject to any disclaimer, the term of this patent is extended or adjusted under 35 U.S.C. 154(b) by 116 days.

(21) Appl. No.: 16/651,694

(22) PCT Filed: Jun. 4, 2018

(86) PCT No.: PCT/CN2018/089784
§ 371 (c)(1),
(2) Date: Mar. 27, 2020

(87) PCT Pub. No.: WO2019/091104
PCT Pub. Date: May 16, 2019

(65) Prior Publication Data

US 2020/0232464 A1 Jul. 23, 2020

(30) Foreign Application Priority Data

Nov. 8, 2017 (CN) ..... 201711093414.3

(51) Int. Cl.
*F03C 2/00* (2006.01)
*F03C 4/00* (2006.01)
(Continued)

(52) U.S. Cl.
CPC ..... *F04C 18/3562* (2013.01); *F04C 28/18* (2013.01); *F04C 29/124* (2013.01); *F04C 2240/811* (2013.01)

(58) Field of Classification Search
CPC ..... F04C 18/3562; F04C 18/3564; F04C 23/008; F04C 28/06; F04C 28/18;
(Continued)

(56) References Cited

U.S. PATENT DOCUMENTS

2005/0002814 A1* 1/2005 Kim ..... F04C 23/001 418/26
2008/0193314 A1* 8/2008 Cho ..... F04C 27/005 418/58
2019/0024662 A1* 1/2019 Wu ..... F04C 18/356

FOREIGN PATENT DOCUMENTS

CN 202579193 U 12/2012
CN 105020138 B 11/2015
(Continued)

OTHER PUBLICATIONS

CN202579193U—Liu et al.—Two-Stage Variable-Capacity Compressor—Dec. 5, 2012—the Machine English Translation (Year: 2012).*

(Continued)

*Primary Examiner* — Theresa Trieu
(74) *Attorney, Agent, or Firm* — Christensen O'Connor Johnson Kindness PLLC

(57) ABSTRACT

Disclosed are a variable-capacity control structure, a compressor and a variable-capacity control method thereof. The variable-capacity control structure includes: a variable-capacity assembly and a sliding vane restraint unit; the variable-capacity assembly is provided outside a housing of a compressor to which the variable-capacity control structure is attached, and is configured to act in a setting order; the sliding vane restraint unit is provided inside a pump body of the compressor, and is configured to cause a variable-capacity cylinder assembly in the compressor to be in a working state or an idling state under controlling the variable-capacity assembly to act in the setting order. By the solution of the present disclosure, advantages that vibration is reduced, compressor is not easy to shut down and pipeline is not easy to break are implemented.

14 Claims, 11 Drawing Sheets

(51) Int. Cl.

| | |
|---|---|
| ***F04C 2/00*** | (2006.01) |
| ***F04C 15/00*** | (2006.01) |
| ***F04C 18/356*** | (2006.01) |
| ***F04C 28/18*** | (2006.01) |
| ***F04C 29/12*** | (2006.01) |

(58) Field of Classification Search
CPC ..... F04C 29/028; F04C 29/124; F04C 2240/811; F04C 2270/50; F04C 2270/52
See application file for complete search history.

(56) References Cited

FOREIGN PATENT DOCUMENTS

| | | | | | |
|---|---|---|---|---|---|
| CN | 105332916 | B | | 2/2016 | |
| CN | 105444474 | B | | 3/2016 | |
| CN | 105485013 | B | | 4/2016 | |
| CN | 105545742 | B | | 5/2016 | |
| CN | 105545752 | B | | 5/2016 | |
| CN | 105756930 | A | | 7/2016 | |
| CN | 105805003 | B | | 7/2016 | |
| CN | 106050663 | B | | 10/2016 | |
| CN | 106122012 | B | | 11/2016 | |
| CN | 107917078 | A | | 4/2018 | |
| CN | 207195139 | U | | 4/2018 | |
| JP | 2008128231 | A | * | 6/2008 | ..... F04C 23/008 |
| JP | 2008133820 | A | * | 6/2008 | ..... F04C 28/26 |
| WO | 2017125079 | A1 | | 7/2017 | |

OTHER PUBLICATIONS

Extended European Search Report dated Sep. 14, 2020, issued in corresponding European Application No. 18875486, 8 pages.

* cited by examiner

VARIABLE-CAPACITY CONTROL STRUCTURE, COMPRESSOR AND VARIABLE-CAPACITY CONTROL METHOD THEREOF

CROSS REFERENCE TO RELATED APPLICATIONS

This application is a National Stage of International Application No. PCT/CN2018/089784, filed Jun. 4, 2018, which claims priority to Chinese Patent Application No. 201711093414.3, entitled "Variable-Capacity Control Structure, Compressor and Variable-Capacity Control Method Thereof", filed on Nov. 8, 2017, the content of which are expressly incorporated herein by reference in its entirety.

TECHNICAL FIELD

The present disclosure relates to the field of compressor technology, and specifically to a variable-capacity control structure, a compressor and a variable-capacity control method thereof, and particularly to a variable-capacity control structure of a rolling rotor variable-capacity compressor, a compressor having the variable-capacity control structure, and a variable-capacity control method for the compressor.

BACKGROUND

The rotor compressor is driven by an engine or an electric motor (mostly driven by an electric motor). The other rotor (also known as a female rotor or a concave rotor) is driven by the main rotor through an oil film formed by oil injection, or driven by synchronous gears at the main rotor end and the concave rotor end. Currently, the air-conditioning system using the rolling-rotor compressor generally use the variable frequency technology to control the rotational speed of the compressor to regulate the cooling and heating output of the air-conditioning system. This technology has advantages of relatively simple control, a large adjustment range of cooling and heat output, and so on.

In recent years, many manufacturers have developed variable-capacity control technology on the multi-cylinder compressor. However, when the variable-capacity control technology is adopted to adjust the working capacity of the compressor, the load of the compressor is suddenly increased or decreased while the variable-capacity cylinder is switched from the idling state to the working state or from the working state to the idling state, causing violent vibration of the compressor, which may easily cause the compressor to stop suddenly or the compressor pipeline to break, and the compressor controller may also be subject to violent current shock. The existence of these problems makes the variable-capacity technology difficult to popularize and apply in large scale, which has become an urgent problem in the industry.

There are defects such as violent vibration, easy shutdown, and easy break of pipeline in the prior art.

SUMMARY

As for the above defects, the objective of the present disclosure is to provide a variable-capacity control structure, a compressor and a variable-capacity control method thereof, to solve the problem of violent vibrations of the compressor caused by sudden change of load of the compressor during the switching of mode, and achieve an effect of significantly reducing the vibrations.

The present disclosure provides a variable-capacity control structure, including: a variable-capacity assembly and a sliding vane restraint unit; wherein the variable-capacity assembly is provided outside a housing of a compressor to which the variable-capacity control structure is attached, and is configured to act in a setting order; the sliding vane restraint unit is provided inside a pump body of the compressor, and is configured to cause a variable-capacity cylinder assembly in the compressor to be in a working state or an idling state under controlling the variable-capacity assembly to act in the setting order.

Optionally, the variable-capacity assembly includes: a check valve; the check valve is provided in a pipeline between a variable-capacity cylinder intake port of a variable-capacity cylinder in the variable-capacity cylinder assembly and a second dispenser outlet of a dispenser in the compressor, and is configured to be in an on state when a refrigerant flows from the second dispenser outlet to the variable-capacity cylinder intake port, or be in a cut-off state when the refrigerant flows from the variable-capacity cylinder intake port to the second dispenser outlet.

Optionally, the variable-capacity assembly further includes: a throttling element and an on-off element; wherein the throttling element is provided in a pipeline in which a high-pressure side control pipe is located, the high-pressure side control pipe being drawn from a high-pressure exhaust side inside the housing, and the throttling element is configured to introduce a high-pressure refrigerant on the high-pressure exhaust side into a place between the check valve and the variable-capacity cylinder intake port according to a setting flow area when both the check valve and the on-off element are in a closed state while the throttling element is in an open state; the on-off element is provided in a pipeline in which a low-pressure side control pipe is located, the low-pressure side control pipe being drawn from a low-pressure intake side inside the dispenser, and the on-off element is configured to introduce a low-pressure refrigerant on the low-pressure intake side into a place between the check valve and the variable-capacity cylinder intake port when the check valve, the throttling element and the on-off element are all in the open state.

Optionally, in the variable-capacity assembly, a common connection pipe is drawn between the variable-capacity cylinder intake port and the check valve, both the other end of the high-pressure side control pipe and the other end of the low-pressure side control pipe are connected to the common connection pipe; and/or, the variable-capacity assembly further includes: a buffer; the buffer is provided in a pipeline in which the common connection pipe drawn between the variable-capacity cylinder intake port and the check valve is located, and the buffer is configured to slow down a speed of decrease of a pressure in the variable-capacity cylinder when the variable-capacity cylinder is switched from the idling state to the working state.

Optionally, the throttling element includes at least one of a first solenoid valve, an electronic expansion valve and a capillary tube; and/or, an upper limit of the setting flow area can be adjusted by the throttling element to be greater than or equal to: a first setting coefficient times a product of an allowable maximum operating frequency of the variable-capacity cylinder assembly when switching between states and a working volume of the variable-capacity cylinder in the working state; wherein the switching the state includes: switching from the working state to the idling state, or switching from the idling state to the working state; and/or, when the variable-capacity cylinder assembly is switched from the working state to the idling state, a time during which an opening degree of the throttling element is reduced from the upper limit to a lower limit of the setting flow area is a first transition time; when the variable-capacity cylinder assembly is switched from the idling state to the working state, a time during which the opening degree of the throttling element is increased from the lower limit to the upper limit of the setting flow area is a second transition time; wherein the first transition time is greater than or equal to a first setting time, the second transition time is greater than or equal to a second setting time, and the second setting time is greater than the first setting time; and/or, the on-off element includes: at least one of a second solenoid valve, an electric switch and a manual switch; and/or, an allowable flow area when the on-off element is turned on is less than or equal to a second setting coefficient times the working volume of the variable-capacity cylinder in the working state; and/or, when the variable-capacity assembly further includes the buffer, a volume of a gas that the buffer can hold is greater than or equal to a third setting coefficient times the working volume of the variable-capacity cylinder in the working state.

Optionally, the sliding vane restraint unit includes any one of a pin restraint unit, a magnetic element restraint unit and a sliding vane restraint hole restraint unit; wherein the pin restraint unit includes: a pin and a pin spring; wherein the pin is provided in a vertical direction of a variable-capacity sliding vane in the variable-capacity cylinder assembly, and is located in a bearing in the compressor, the bearing being adjacent to the variable-capacity cylinder in the variable-capacity cylinder assembly; the pin spring is provided at a tail portion of the pin; and/or the magnetic element restraint unit includes a magnetic element; the magnetic element is provided at a tail portion of the variable-capacity sliding vane in the variable-capacity cylinder assembly, and is configured to attract the variable-capacity sliding vane to make the variable-capacity sliding vane move toward the magnetic element; and/or, the sliding vane constraint hole constraint unit includes a sliding vane constraint hole; the sliding vane restraint hole is located in a direction at a setting angle to a moving direction of the variable-capacity sliding vane in the variable-capacity cylinder assembly, and is provided on a side of the variable-capacity cylinder in the variable-capacity cylinder assembly, the a side being opposite to the variable-capacity cylinder intake port of the variable-capacity cylinder, the sliding vane restraint hole is configured to introduce a high-pressure gas in the housing to a side of a variable-capacity sliding vane groove of the variable-capacity sliding vane and is in communication with the variable-capacity sliding vane groove.

Optionally, the pin restraint unit further includes: a pin groove; the pin groove is provided at a tail portion of the variable-capacity sliding vane in a vertical direction; the pin is provided in the pin groove; and/or, in the pin restraint unit, both the tail portion and a head portion of the variable-capacity sliding vane are in communication with the high-pressure gas in the housing; a pressure on the head portion of the variable-capacity sliding vane is the same as a pressure inside the variable-capacity cylinder; the tail portion of the pin communicates with the variable-capacity cylinder intake port of the variable-capacity cylinder through a pin communication channel inside the pump body in the compressor; and or, in the sliding vane restraint hole restraint unit, the high pressure gas in the housing is introduced by the sliding vane restraint hole to a side of the variable-capacity sliding vane groove of the variable-capacity sliding vane to form a pressure acting on the variable-capacity sliding vane, such that the variable-capacity sliding vane tightly fits the other side of the variable-capacity sliding vane groove; a direction of the pressure is perpendicular to a direction of a linear movement of the variable-capacity sliding vane, to make a frictional force generated between the variable-capacity sliding vane and a tightly fitted side of the variable-capacity sliding vane groove, to prevent the variable-capacity sliding vane from moving.

To match the above variable-capacity control structure, the present disclosure in another aspect provides a compressor, including: at least one compression cylinder assembly operating constantly; further including: at least one variable-capacity cylinder assembly capable of selectively being in a working state or an idling state; wherein the variable-capacity cylinder assembly includes the above-mentioned variable-capacity control structure.

To match the above compressor, the present disclosure in another aspect provides a variable-capacity control method for a compressor, including: causing the variable-capacity assembly to act in a setting order; causing, by a sliding vane restraint unit, a variable-capacity cylinder assembly in the compressor to be in a working state or an idling state under controlling the variable-capacity assembly to act in the setting order.

Optionally, when the variable-capacity assembly includes a check valve, a throttling element and an on-off element, the causing the variable-capacity assembly to act in the setting order includes: during a switching process of the variable-capacity cylinder assembly from the working state to the idling state, causing the on-off element to be in a closed state; causing an opening degree of the throttling element to gradually increase from a lower limit to an upper limit of a setting flow area within a first transition time; after completing the switching process of the variable-capacity cylinder assembly from the working state to the idling state, causing the opening degree of the throttling element to be any opening degree in a range from the lower limit to the upper limit of the setting flow area, and maintaining the on-off element in a closed state; or, during the switching process of the variable-capacity cylinder assembly from the idling state to the working state: causing the opening degree of the throttling element to be at the upper limit of the setting flow area; causing the on-off element to be in an open state; causing the opening degree of the throttling element to be gradually reduced from the upper limit to the lower limit of the setting flow area within a second transition time; after completing the switching process of the variable-capacity cylinder assembly from the idling state to the working state, causing the opening degree of the throttling element to be at the lower limit of the setting flow area, and maintaining the on-off element in the open state, or causing the on-off element to be in the closed state; wherein, when the throttling element is in the closed state and the on-off element is in the open state, causing the check valve to be in an on state; or, when the throttling element is in the open state and the on-off element is in the closed state, causing the check valve to be in the closed state.

Optionally, when the variable-capacity assembly further includes a buffer, the causing the variable-capacity assembly to act in the setting order further includes: during the switching process of the variable-capacity cylinder assembly from the idling state to the working state, slowing down a speed of decrease of a pressure in the variable-capacity cylinder in the variable-capacity cylinder assembly through the buffer.

Optionally, the slowing down the speed of the decrease of the pressure in the variable-capacity cylinder in the variable-capacity cylinder assembly includes: in a process of reducing the opening degree of the throttling element from the upper limit to the lower limit of the setting flow area, causing a volume of a high-pressure gas entering the buffer from the inside of the housing to reduce, and causing a volume of a high-pressure gas flowing out of the buffer from the on-off element not to change; and causing a pressure of a gas from the variable-capacity cylinder intake port of the variable-capacity cylinder to an inside of the buffer to gradually decrease, and causing a pressure difference between the decreased pressure and an exhaust back pressure of the compressor to meet a condition under which the variable-capacity sliding vane of the variable-capacity cylinder assembly is free from a constraint of the sliding vane restraint unit.

Optionally, when the sliding vane restraint unit includes a pin restraint unit, the causing variable-capacity cylinder assembly in the compressor to be in the working state or the idling state includes: during the switching process of the variable-capacity cylinder assembly from the working state to the idling state: gradually increasing a pressure on a variable-capacity cylinder intake side of the variable-capacity cylinder in the variable-capacity cylinder assembly through the variable-capacity assembly, until a pin spring at a tail portion of a pin is sufficient to overcome a gas force with a direction opposite to a direction of a spring force of the pin spring, a pressure difference between a head portion and a tail portion of the pin being a first pressure difference; when the variable-capacity sliding vane of the variable-capacity cylinder assembly is pushed into a setting position in a variable-capacity cylinder sliding vane groove of the variable-capacity cylinder assembly under a rotation of a roller of the variable-capacity cylinder assembly, the pin enters a pin groove of the compressor on the variable-capacity sliding vane to restrain a movement of the variable-capacity sliding vane; after that, the variable-capacity sliding vane is disengaged from the roller; causing a pressure in the variable-capacity cylinder to continue to increase until the pressure in the variable-capacity cylinder is equal to a high pressure in the housing, then the switching process ends, and the variable-capacity cylinder assembly is in the idling state; or, during the switching process of the variable-capacity cylinder assembly from the idling state to the working state: gradually decreasing the pressure in the variable-capacity cylinder in the variable-capacity cylinder assembly through the variable-capacity assembly, until the gas force applied on the pin is sufficient to overcome the spring force of the pin spring and pushes the pin away from the variable-capacity sliding vane of the variable-capacity cylinder assembly, a pressure difference between the head portion and the tail portion of the pin being the first pressure difference;

releasing the restraint applied on the variable-capacity sliding vane, meanwhile due to the pressure in the variable-capacity cylinder is decreased, a pressure difference between a head portion and a tail portion of the variable-capacity sliding vane being the first pressure difference; driving, by a gas force generated by the first pressure difference, the variable-capacity sliding vane to moves toward the roller of the variable-capacity cylinder assembly until the variable-capacity sliding vane fits the roller, the variable-capacity cylinder assembly starts to inhale and compress, and a power of the compressor starts to increase accordingly; until the pressure in the variable-capacity cylinder is equal to a pressure at a dispenser intake port of a dispenser in the compressor, the check valve in the variable-capacity assembly is turned on, then the switching process ends, and the variable-capacity cylinder assembly is in the working state; or, when the sliding vane restraint unit includes a magnetic element restraint unit, the causing the variable-capacity cylinder assembly in the compressor to be in the working state or in the idling state includes: during the switching process of the variable-capacity cylinder assembly from the working state to the idling state: gradually increasing the pressure inside the variable-capacity cylinder in the variable-capacity cylinder assembly through the variable-capacity assembly, to closes the check valve in the variable-capacity assembly until the pressure inside the variable-capacity cylinder is increased to an extent such that the magnetic element is sufficient to overcome the gas force generated by the variable-capacity sliding vane of the variable-capacity cylinder assembly due to a pressure difference between a head portion and a tail portion of the variable-capacity sliding vane, the pressure difference between the head portion and the tail portion of the variable-capacity sliding vane being a second pressure difference; pushing the variable-capacity sliding vane into the variable-capacity sliding vane groove of the variable-capacity cylinder assembly by a rotating roller in the variable-capacity cylinder assembly, and restraining the variable-capacity sliding vane in the variable-capacity cylinder sliding vane groove due to a magnetic force generated by the magnetic element on the variable-capacity sliding plate; after that, continuously increasing the pressure inside the variable-capacity cylinder to be equal to the pressure inside the housing, then ending the switching process and the variable-capacity cylinder assembly being in the idling state; or, during the switching process of the variable-capacity cylinder assembly from the idling state to the working state: gradually decreasing the pressure inside the variable-capacity cylinder in the variable-capacity cylinder assembly through the variable-capacity assembly, until the pressure inside the variable-capacity cylinder is decreased to an extent such that the gas force generated by the variable-capacity sliding vane in the variable-capacity cylinder assembly due to the pressure difference between the head portion and the tail portion of the variable-capacity sliding vane is sufficient to overcome the magnetic force applied by the magnetic element on the variable-capacity sliding vane, the pressure difference between the head portion and the tail portion of the variable-capacity sliding vane being the second pressure difference; causing the variable-capacity sliding vane to be freed from a restraint of the magnetic element, and causing the variable-capacity sliding vane to move toward the roller of the compressor under the action of the gas force until the variable-capacity sliding vane fits the roller, such that a space in the variable-capacity assembly is divided into a space on an intake side and a space on an exhaust side; continuously decreasing a pressure on a variable-capacity cylinder intake side of the variable-capacity cylinder, to gradually increase a power of the compressor until the pressure on the variable-capacity cylinder intake side is equal to the pressure at the dispenser intake port of the dispenser in the compressor, causing the check valve in the variable-capacity assembly to turn on, then ending the switching process and causing the variable-capacity cylinder assembly to be in the working state; or, when the sliding vane restraint unit includes a sliding vane restraint hole restraint unit, the causing the variable-capacity cylinder assembly in the compressor to be in the working state or in the idling state includes: during the switching process of the variable-capacity cylinder assembly from the working state to the idling state: gradually increasing the pressure on the variable-capacity cylinder intake side of the variable-capacity cylinder in the variable-capacity cylinder assembly through the variable-capacity assembly, until a frictional force generated by the sliding vane restraint hole on the variable-capacity sliding vane in the variable-capacity cylinder assembly is sufficient to overcome the gas force generated by the variable-capacity sliding vane due to the pressure difference, the pressure difference between the head portion and the tail portion being a third pressure difference; pushing the variable-capacity sliding vane into the variable-capacity cylinder sliding vane groove in the variable-capacity cylinder assembly, and restraining the variable-capacity sliding vane in the variable-capacity cylinder sliding vane groove through the frictional force; then continuously increasing the pressure on the variable-capacity cylinder intake side of the variable-capacity cylinder to be equal to the pressure in the housing, ending the switching process, the variable-capacity cylinder assembly being in the idling state; or, during the switching process of the variable-capacity cylinder assembly from the idling state to the working state: gradually decreasing the pressure inside the variable-capacity cylinder in the variable-capacity cylinder assembly through the variable-capacity assembly, until the pressure inside the variable-capacity cylinder is decreased to an extent such that the gas force generated by the variable-capacity sliding vane in the variable-capacity cylinder assembly due to the pressure difference between the head portion and the tail portion of the variable-capacity sliding vane is sufficient to overcome a frictional force on the variable-capacity sliding vane generated due to a high pressure introduced by the sliding vane restraint hole, the pressure difference between the head portion and the tail portion of the variable-capacity sliding vane being the third pressure difference; causing the variable-capacity sliding vane to be freed from a restraint of the frictional force, and to move toward the roller in the compressor under an action of the gas force generated by the variable-capacity sliding vane due to the pressure difference between the head portion and the tail portion of the variable-capacity sliding vane, until the variable-capacity sliding vane fits the roller, the space in the variable-capacity assembly being divided into a space on an intake side and a space on an exhaust side; continuously decreasing the pressure on the variable-capacity cylinder intake side of the variable-capacity cylinder to gradually increase the power of the compressor, until the pressure on the variable-capacity cylinder intake side is equal to the pressure at the dispenser intake port of the dispenser in the compressor, causing the check valve in the variable-capacity assembly to turn on, ending the switching process, the variable-capacity cylinder assembly being in the working state.

In the solution of the present disclosure, by controlling the variable-capacity assembly to act orderly, vibrations of the compressor during the mode switching are significantly reduced, thereby avoiding the problems such as shutdown and pipeline break when switching mode of the compressor.

Furthermore, in the solution of the present disclosure, by controlling the variable-capacity assembly to act orderly, the probability of vibration and shutdown of the compressor during the mode switching is significantly reduced, thereby avoiding the pipeline break caused by the switching, and improving the reliability of the mode switching of the compressor.

Furthermore, in the solution of the present disclosure, by causing the variable-capacity assembly to act orderly and combining the sliding vane restraint unit, to make the variable-capacity cylinder assembly in a working or idling state, the violent vibration during the state switching is significantly reduced, and the reliability of the state switching and operation of the compressor are improved.

Therefore, in the solution of the present disclosure, by providing a variable-capacity assembly and a sliding vane restraint unit, and controlling the variable-capacity assembly to act orderly, and controlling the variable-capacity cylinder assembly to be in an working state or an idling state, the problem of violent vibration of the compressor caused by the sudden change of the load of the compressor when switching the mode of the compressor is solved, accordingly the defects such as violent vibration, easy shutdown and pipeline break are overcome, thereby implementing advantages that vibration is reduced, compressor is not easy to shut down and pipeline is not easy to break.

Other characteristics and advantages of the present disclosure will be described below, and part of which become apparent from the description, or be understood by implementing the present disclosure.

The technical solution of the present disclosure will be detailed below with reference to the accompanying drawings and embodiments.

BRIEF DESCRIPTION OF DRAWINGS

The accompanying drawings forming a part of the present disclosure are used for providing a further understanding of the present disclosure. The exemplary embodiments and the descriptions thereof in the present disclosure are used for explaining the present disclosure, and do not constitute an improper limitation on the present disclosure. In the accompanying drawings.

With reference to the drawings, the reference signs in the embodiments of the present disclosure are given as follows:

1, housing; 2, invariable-capacity cylinder; 3, pump spring; 4, variable-capacity cylinder; 5, variable-capacity sliding vane; 6, pin; 7, pin spring; 8, sliding vane restraint unit; 9, pin communication channel; 10, variable-capacity cylinder intake port; 11, dispenser; 12, first dispenser outlet; 13, second dispenser outlet; 14, check valve; 15, dispenser intake port; 16, buffer; 17, first solenoid valve; 18, second solenoid valve; 19, exhaust pipe; 20, roller; 21, sliding vane; 22, magnetic element; 23, sliding vane restraint hole; 24, sliding vane head portion; 25, sliding vane tail portion; 26, pin groove; 27, low-pressure intake side; 28, high-pressure exhaust side; 29, low-pressure side control pipe; 30, common connection pipe; 31, high-pressure side control pipe.

DETAILED DESCRIPTION OF DISCLOSED EMBODIMENTS

In order to make the objectives, technical solutions and advantages of the present disclosure clearer, the technical solutions of the present disclosure will be clearly and completely described in combination with specific embodiments and corresponding drawings of the present disclosure. Apparently, the described embodiments are merely a part of the embodiments of the present disclosure, but not all embodiments. Based on the embodiments of the present disclosure, all other embodiments obtained by those skilled in the art without creative effort shall fall within the scope of protection scope of the present disclosure.

In an embodiment, a variable-capacity control structure can provided on one or more compression cylinders, such that a sliding vane in the cylinder contacts a roller to work normally (the cylinder is referred to as a variable-capacity cylinder), or such that the sliding vane in the variable-capacity cylinder is disengaged from the roller and idled, which changes the current working volume of the compressor and implements the adjustment of the compressor capacity. Due to load mutation when the mode of the rolling-rotor variable-capacity compressor is switched, the compressor vibrates violently during the switching of mode, which affects the application of the technology.

Figure 1:
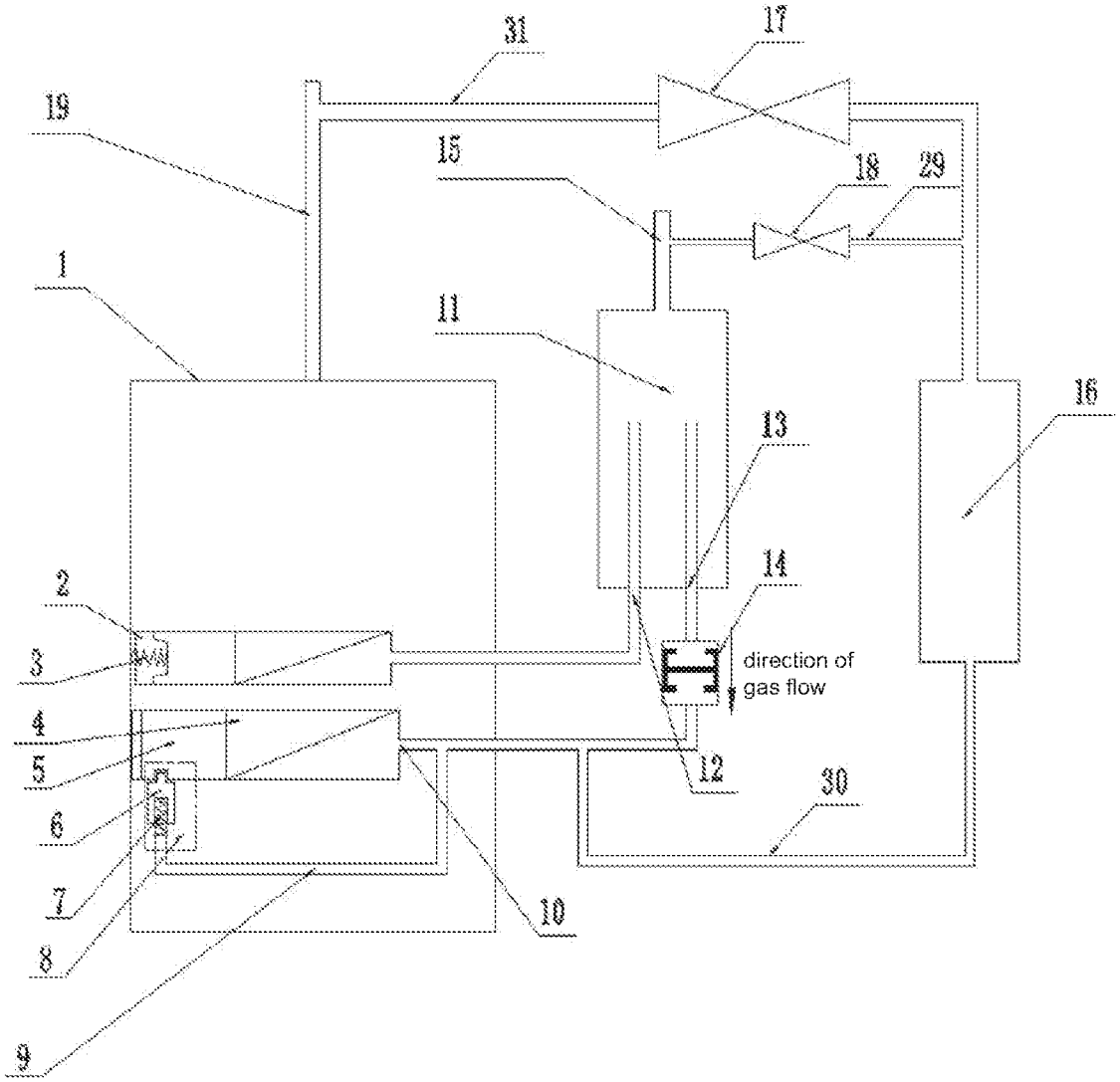
FIG. 1 is a schematic structure diagram illustrating a pin restraint structure according to an embodiment of the present disclosure.

As for the above-mentioned problems of violent vibration, easy shutdown of the compressor when switching the mode of the variable-capacity compressor, according to an embodiment of the present disclosure, a variable-capacity control structure is provided, as shown in FIG. 1, a schematic structure diagram illustrating a variable-capacity control structure. The variable-capacity control structure may include: a variable-capacitance assembly and a sliding vane restraint unit 8.

In an optional example, the variable-capacity assembly is provided outside the housing 1 of the compressor to which the variable-capacity control structure is attached, and can be configured to operate in a setting order.

The compressor may include a housing, a motor and a pump body. The motor may include a stator and a rotor; and the rotor, though a crankshaft, is connected to the pump body as a whole. The pump body may include a compression cylinder assembly. The compression cylinder assembly may include: a compression cylinder assembly capable of selectively being in a working state or an idling state, that is, a variable-capacity cylinder assembly.

For example, the process of the variable-capacity cylinder switching from a working mode to an idling mode may include:

(1) a second solenoid valve is closed (if the second solenoid valve was in the closed state before, the second solenoid valve maintains the closed state);

(2) a flow area of a first solenoid valve is gradually increased from 0 to a maximum value S1, with the time duration $T_1$;

(3) after the switching process is completed, the state of the first solenoid valve can be a state with the flow area of 0 or the maximum value S1, and the second solenoid valve continuously maintains the closed state.

For example, the process of the variable-capacity cylinder switching from the idling mode to the working mode may include:

(1) the flow area opening the first solenoid valve is controlled to be the maximum value S1;

(2) the second solenoid valve is switched from the closed state to the open state with the maximum allowable flow area S2;

(3) the flow area of the first solenoid valve is gradually decreased from the maximum value S1 to 0, with the time duration T2;

(4) after the completion of the switching, the flow section of the first solenoid valve is 0 (that is, a completely closed state), and the second solenoid valve continuously maintains the open state or maintains the closed state.

Thus, through providing of the variable-capacity assembly which can operate in a setting order, the probability of vibration and shutdown of the compressor during mode switching is significantly reduced, thereby avoiding the pipeline break caused by the switching, implementing the reliability of control of the switching of the state of the variable-capacity cylinder assembly, and improving the reliability of compressor switching.

Optionally, the variable-capacity assembly may include: a check valve 14.

In an optional specific example, the check valve 14 is provided in a pipeline between a variable-capacity cylinder intake port 10 of the variable-capacity cylinder 4 in the variable-capacity cylinder assembly and a second dispenser outlet of a dispenser 11 in the compressor. The check valve 14 can be configured to be in an on state when the refrigerant flows from the second dispenser outlet 13 to the variable-capacity cylinder intake port 10, or be in a cut-off state when the refrigerant flows from the variable-capacity cylinder intake port 10 to the second dispenser outlet 13.

The second dispenser outlet 13 is one outlet of the outlets of the dispenser 11 which is in communication with the variable-capacity cylinder intake port 10.

For example, the variable-capacity assembly may include a check valve (for example, the check valve 14) provided at the variable-capacity cylinder intake port (for example, the variable-capacity cylinder intake port 10) and the second dispenser outlet (for example, the second dispenser outlet 13).

For example, when the refrigerant has a tendency to flow from the second dispenser outlet to the variable-capacity cylinder intake port, the check valve is in an on state; when the refrigerant has a tendency to flow from the variable-capacity cylinder intake port to the second dispenser outlet, the check valve is in a closed state, that is, the check valve has characteristics of forward guide and reverse cutoff.

Therefore, by providing a check valve, the flow direction of the refrigerant between the second dispenser outlet and the variable-capacity cylinder intake port can be controlled, the control structure is simple, and the control is well convenient.

Optionally, the variable-capacity assembly may further include at least one of a throttling element and an on-off element.

For example, the throttling element or the on-off element can selectively introduce the low-pressure refrigerant or the high-pressure refrigerant into a place between the check valve and the variable-capacity cylinder intake port. Specifically, when the second solenoid valve is turned on while the first solenoid valve is closed, the low-pressure refrigerant can be directed to the place, and at this time, the check valve is in an on state; when the first solenoid valve is turned on while the second solenoid valve is closed, the high-pressure refrigerant can be directed to the place, and the check valve is in a closed state at this time.

In an optional specific example, the throttling element is provided in a pipeline in which the high-pressure-side control pipe 31 is located, and the high-pressure-side control pipe 31 is drawn from the high-pressure exhaust side 28 in the housing 1. The throttling element can be configured to, when both the check valve 14 and the on-off element are in the closed state while the throttling element is in the on state, introduce the high-pressure refrigerant at the high-pressure exhaust side 28 into the place between the check valve 14 and the variable-capacity cylinder intake port 10 according to a setting flow area.

For example, when the throttling element is opened and the on-off element is closed, the high-pressure refrigerant can be introduced into the place between the check valve 14 and the variable-capacity cylinder intake port 10, and the check valve 14 is in the closed state at this time.

For example, the first solenoid valve has ability to adjust the flow area, and adjustment range thereof can be gradually adjusted from 0 (that is, completely closed state) to the maximum capacity.

As a result, the flow area, through which the high-pressure refrigerant on the high-pressure exhaust side of the compressor is introduced into the place between the check valve and the variable-capacity cylinder intake port, is controlled though the throttling element. The control mode is simple, the control result has well accuracy and high reliability.

The throttling element may include at least one of a first solenoid valve 17, an electronic expansion valve and a capillary tube.

For example, the first solenoid valve may be replaced by an electronic expansion valve.

For example, the first solenoid valve needs to have the characteristic of adjustable flow area. The electronic expansion valve currently used for throttling in air conditioners has the characteristic of adjustable flow area.

Therefore, various forms of throttling elements are beneficial to improve the convenience and flexibility of control of the flow area for the refrigerant.

More optionally, an upper limit of the setting flow area that the throttling element can adjust is greater than or equal to: a first setting coefficient times a product of the allowable maximum operating frequency of the variable-capacity cylinder assembly when switching between states and the working volume of the variable-capacity cylinder 4 in the working state. The step of the switching the state may include: the switching is performed from a working state to an idling state, or from an idling state to a working state.

For example, the maximum flow area $S_1$ of the first solenoid valve satisfies $S_1 \geq 0.0147$ fV, with a unit $mm^2$. Where, f is the maximum allowable operating frequency of the variable-capacity cylinder assembly when switching between states; and V is the working volume of the variable-capacity cylinder during normal operation, with a unit $cm^3$.

Therefore, the rationality and reliability of the control of the flow area of the refrigerant can be improved by limiting the range of the flow area of the refrigerant that the throttling element can adjust.

More optionally, when the variable-capacity cylinder assembly is switched from the working state to the idling state, time taken for decreasing the opening degree of the throttling element from the upper limit to the lower limit of the setting flow area is referred to as a first transition time.

For example, a transition region is set between the working mode and the idling mode of the variable-capacity cylinder, and the duration of the transition region satisfies $T1 \geq 5$ seconds.

In a further optional specific example, when the variable-capacity cylinder assembly is switched from an idling state to a working state, time taken for increasing the opening degree of the throttling element from the lower limit to the upper limit of the setting flow area is referred to as a second transition time. The first transition time is greater than or equal to the first setting time, the second transition time is greater than or equal to the second setting time, and the second setting time is greater than the first setting time.

For example, a transition region is set between the idling mode and working mode of the variable-capacity cylinder, and the time duration of the transition region satisfies $T2 \geq 10$.

Therefore, by setting the opening degree of the throttling element to increase and decrease the time, the adjustment speed of the opening degree can be flexibly controlled, and then the reliability and accuracy of the control of the flow are of the refrigerant can be improved.

In an optional specific example, the on-off element is provided in a pipeline in which the low-pressure side control pipe 29 is located, and the low-pressure side control pipe 29 is drawn from the low-pressure intake side 27 inside the dispenser 11. The on-off element can be configured to, when the check valve 14, the throttling element and the on-off element are all in an open state, introduce the low-pressure refrigerant on the low-pressure intake side 27 into a place between the check valve 14 and the variable-capacity cylinder intake port 10.

For example, when the on-off element is opened and the throttling element is closed, the low-pressure refrigerant can be introduced into a place between the check valve 14 and the variable-capacity cylinder intake port 10, and the check valve 14 is in an on state at this time. (i.e., the open state).

Therefore, the connection and disconnection of introduction of the low-pressure refrigerant on the low-pressure intake side of the compressor into the place between the check valve and the variable-capacity cylinder intake port, is controlled by the on-off element. The control mode is simple, and the control result has a high reliability.

The on-off element may include at least one of a second solenoid valve 18, an electric switch and a manual switch.

For example, the second solenoid valve may also be a valve which can be manually controlled to open and close, but such valve cannot implement automatic control and the operation is inconvenient.

Therefore, various forms of on-off elements are beneficial to improve the convenience and flexibility of on-off control, and have strong versatile and wide application range.

More optionally, the allowable flow area when the on-off element is opened is less than or equal to a second setting coefficient times the working volume of the variable-capacity cylinder 4 in the working state.

For example, the second solenoid valve has completely closed and open state, and the maximum allowed flow area in the open state satisfies $S2 \leq 0.587V$ with the unit $mm^2$. Where, V is the working volume of the variable-capacity cylinder during normal operation, with the unit $cm^3$.

Therefore, the rationality and reliability of control of the low-pressure refrigerant flow can be improved by setting the allowable flow area of the on-off element.

In an optional specific example, in the variable-capacity assembly, a common connection pipe 30 is further drawn between the variable-capacity cylinder intake port 10 and the check valve 14. Both the other end of the high-pressure-side control pipe 31 and the other end of the low-pressure-side control pipe 29 are connected to the common connection pipe 30.

For example, the variable-capacity assembly may further include: a pipe drawn from the inside of the housing (for example, the housing 1) (for example, from the compressor exhaust port, i.e., the high-pressure exhaust side 28), a high-pressure-side control pipe (for example, the exhaust pipe 19) connected to the first solenoid valve (for example, the first solenoid valve 17), a pipe drawn from the low-pressure intake side (for example, low-pressure intake side 27), a low-pressure-side control pipe (for example, the low-pressure-side control pipe 29) connected to the second solenoid valve (for example, the second solenoid valve 18), and a common connection pipe (for example, the common connection pipe 30) drawn from a place between the variable-capacity cylinder intake port and the check valve. The common connection pipe is connected to the other end of the high-pressure-side control pipe and the other end of the low-pressure-side control pipe respectively (for example, see the examples shown in FIGS. 1 to 3, 4 to 5, and 6 to 7).

Therefore, through leading the common connection pipe from a place between the variable-capacity cylinder intake port and the check valve, both the high-pressure-side control pipe and the low-pressure-side control pipe can be connected to the common connection pipe. The pipeline structure is simple, and the connection reliability is high.

Optionally, the variable-capacity assembly may further include: a buffer 16.

In an optional specific example, the buffer 16 is provided in a pipeline in which the common connection pipe 30 is located, and the common connection pipe 30 is drawn from the place between the variable-capacity cylinder intake port 10 and the check valve 14. The buffer 16 can be configured to, when the variable-capacity cylinder 4 is switched from the idling state to the working state, slow down the decrease of the pressure inside the variable-capacity cylinder 4.

For example, the roller-rotor compressor may include: a constant-running compression cylinder assembly and a variable-capacity cylinder assembly with optional performance for normal work or idling. Switching of the working mode of the variable-capacity cylinder assembly is implemented through a combined action of the external variable-capacity assembly and the sliding vane restraint unit; the variable-capacity assembly includes a check valve provided between the variable-capacity cylinder intake port and the second dispenser outlet, a low-pressure-side control pipe drawn from the dispenser intake port (or a position at which the pressure is the same as that at the dispenser intake port) and a second solenoid valve, a high-pressure-side control pipe drawn from the exhaust pipe (or a position at which the pressure is the same as that inside the housing) and a first solenoid valve, a common-side connection pipe drawn from a place between the variable-capacity cylinder intake port and the check valve and a buffer connected to the common-side connection pipe. The high-pressure-side control pipe and the low-pressure-side control pipe are connected to the common-side connection pipe, to make the high-pressure-side control pipe and the low-pressure-side control pipe have a capability of introducing a high pressure inside the housing (for example, the housing 1) into the variable-capacity cylinder intake port or introducing the high pressure inside the variable-capacity cylinder and the buffer into the dispenser.

For example, there is a buffer and the flow area of the first solenoid valve is the maximum, the pressure at the variable-capacity cylinder intake port is decreased to a certain extent, but the decreasing amplitude of the pressure is controlled. The flow area of the first solenoid valve is gradually reduced, the high-pressure gas entering the buffer from the inside of the housing is reduced, and the high-pressure gas flowing out of the buffer from the second solenoid valve is not changed, such that the pressure is gradually decreased from the variable-capacity cylinder intake port to the buffer, and has a pressure difference $\Delta P_0$ with exhaust back pressure.

Therefore, by providing a buffer in the common connection pipe between the variable-capacity cylinder intake port and the check valve, the decrease of the pressure inside the variable-capacity cylinder during the switching from the idling state to the working state is further slowed down, and then the vibration degree of the compressor in the process of state switching is further reduced, thereby improving the reliability and safety of the state switching and operation.

More optionally, when the variable-capacity assembly may further include a buffer 16, the volume of gas that can be contained in the buffer 16 is greater than or equal to a third setting coefficient times the working volume of the variable-capacity cylinder 4 in the working state.

For example: the volume of the gas that can be contained in the buffer satisfies $V_h \geq 10V$.

Therefore, by setting the volume of the gas contained in the buffer, the degree of decrease of the pressure inside the variable-capacity cylinder can be controlled more reasonably and reliably.

In an optional example, the sliding vane restraint unit 8 is provided inside the pump body of the compressor, and can be configured to make the variable-capacity cylinder assembly in the compressor be in the working state or idling state under the control by which the variable-capacity assembly is operated in a setting order, to implement the control of the capacity of the compressor.

For example, the sliding vane restraint unit 8 implements the switching of the state of the variable-capacity cylinder assembly in the compressor under the control by which the variable-capacity assembly is operated in a setting order. The switching of the state may include: switching from a working state to an idling state, or switching from an idling state to a working state.

For example, when the sliding vane 21 inside the variable-capacity cylinder 4 in the variable-capacity cylinder assemble contacts the roller 20, the space inside the variable-capacity cylinder 4 is divided into a space on a low-pressure intake side 27 and a space on a high-pressure exhaust side 28, volumes of which vary with the rotation angle. The crankshaft of the compressor rotates to compress the gas sucked into the variable-capacity cylinder 4, such that the variable-capacity cylinder 4 is in a normal working state.

Another example, when the sliding vane 21 in the variable-capacity cylinder 4 returns to the sliding vane groove of the variable-capacity cylinder assembly and restrained in the sliding vane groove by the sliding vane restraint unit 8, such that the sliding vane 21 is separated from the roller 20 of the variable-capacity cylinder assembly, and only one chamber is left in the variable-capacity cylinder 4 and connected to the variable-capacity cylinder intake side (i.e., the variable-capacity cylinder intake port side). When the crankshaft rotates, the gas in the variable-capacity cylinder assembly is no longer compressed, such that the variable-capacity cylinder 4 is in an idling state.

For example, when the sliding vane in the variable-capacity cylinder (for example, the variable-capacity cylinder 4) contacts the roller, the space in the variable-capacity cylinder is divided into a space on a low-pressure intake side and a space on a high-pressure exhaust side, volumes of which vary with the rotation angle. The crankshaft rotates to compress the gas sucked into the variable-capacity cylinder, and the variable-capacity cylinder is in a normal working state at this time.

For example, when the sliding vane in the variable-capacity cylinder returns to the sliding vane groove and is restrained in the sliding vane groove by a sliding vane restraint unit provided in the pump body, the sliding vane is separated from the roller, and only one chamber is left in the variable-capacity cylinder and connected to the variable-capacity cylinder intake side. When the crankshaft rotates, the gas in the variable-capacity cylinder assembly is no longer compressed, and the variable-capacity cylinder is in the idling state at this time.

The working mode (for example, the working state, the idling state, etc.) of the variable-capacity cylinder assembly is determined by the combined action of the variable-capacity assembly provided outside the housing and the sliding vane restraint unit provided in the pump body.

Therefore, through the cooperative setting of the variable-capacity assembly and the sliding vane restraint unit, it is possible to control the variable-capacity assembly to orderly act, which greatly reduces the vibration of the compressor during mode switching, and avoids the problems of shutdown, pipeline break and so on during switching the state of the compressor.

Optionally, the slider restraint unit 8 may include a pin restraint unit. The pin restraint unit may include a pin 6 and a pin spring 7.

In an optional specific example, the pin 6 is provided in a vertical direction of the variable-capacity sliding vane 5 in the variable-capacity cylinder assembly and located in a bearing of the compressor adjacent to the variable-capacity cylinder 4. In an optional specific example, the pin spring 7 is disposed at a tail portion of the pin 6. The tail of the pin 6 is an end of the pin 6 far from the variable-capacity sliding vane 5.

Therefore, through the adaptive setting of the pin and the pin spring, the restraint force on the variable-capacity sliding vane is large, and then the reliability and safety of the control of the variable-capacity sliding vane are improved.

More optionally, in the pin restraint unit, both the tail portion of the variable-capacity sliding vane 5 and the head portion of the pin 6 are in communication with the high-pressure gas inside the housing 1. The tail portion of the variable-capacity sliding vane 5 is an end close to the head portion of the pin 6. The head portion of the variable-capacity sliding vane 5 is an end far from the head portion of the pin 6.

In a more optional specific example, the pressure on the head portion of the variable-capacity sliding vane 5 is the same as the pressure inside the variable-capacity cylinder 4.

In a more optional specific example, the tail portion of the pin 6 is communicated with the variable-capacity cylinder intake port of the variable-capacity cylinder 4 through a pin communication channel 9 inside the pump body in the compressor.

More optionally, the pin restraint unit may further include a pin groove 26. The pin groove 26 is provided at a tail portion of the variable-capacity sliding vane 5 in a vertical direction. The pin 6 is provided in the pin groove 26.

Figure 2:
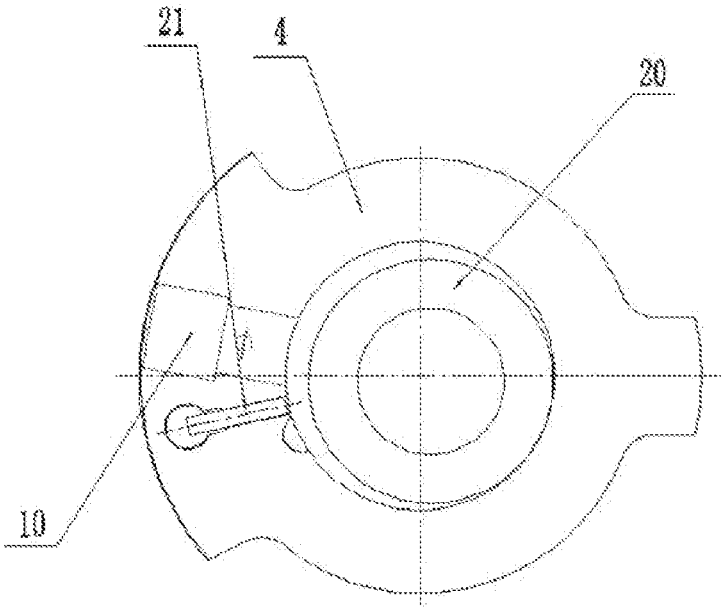
FIG. 2 is a schematic structure diagram illustrating a state in which a variable-capacity sliding vane is disengaged from a roller according to an embodiment.
Figure 3:
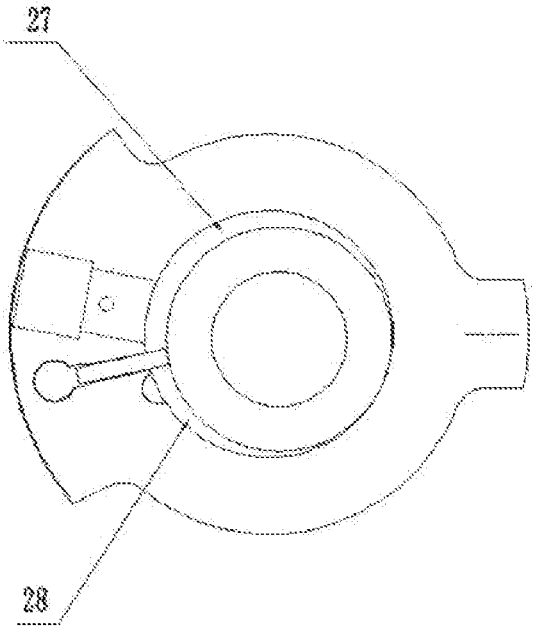
FIG. 3 is a schematic structure diagram illustrating a state in which a variable-capacity sliding sheet fits a roller according to an embodiment.

For example, the structure of the pin restraint unit is described in an embodiment I shown in FIG. 1 to FIG. 3. The sliding vane restraint unit may include: a pin (for example, pin 6) provided in a vertical direction of a variable-capacity sliding vane (for example, variable-capacity sliding vane 5) in a variable-capacity cylinder assembly, and a spring (for example: pin spring 7) provided on the tail portion of the pin.

One end of the variable-capacity sliding vane is close to the roller (e.g., roller 20) in the radial direction of the cylinder, which is referred to as a sliding vane head portion, such as the sliding vane head portion 24; and the other end is away from the roller, which is referred to as a sliding vane tail portion, such as the sliding vane tail portion 25. The variable-capacity sliding vane is restrained by the bearings on both sides in the axial direction of the cylinder, and is provided with a pin groove (for example, a pin groove 26) on the side near the pin.

Specifically, the pin is provided in a bearing adjacent to the variable-capacity cylinder, one end of the pin is close to the variable-capacity sliding vane (referred to as a pin head portion), and the other end is far from the variable-capacity sliding vane (referred to as a pin tail portion). The sliding vane tail portion and the pin head portion communicate with the high pressure inside the housing. The pressure on the sliding vane head portion is the same as the pressure in the variable-capacity cylinder. The pin tail portion is connected to the intake port of the variable-capacity cylinder through the pin communication channel (for example, the pin communication channel 9) inside the pump body.

In a more optional specific example, the switching process of the variable-capacity cylinder assembly from the normal working mode to the idling mode may include:

when the pressure in the variable-capacity cylinder is at a low pressure and the pressure is equal to the pressure at the dispenser intake port, the variable-capacity cylinder assembly is in a normal working state. The pressure at the intake side of the variable-capacity cylinder is gradually increased through the variable-capacity assembly until the spring at the tail portion of the pin is sufficient to overcome the gas force with a direction opposite to the direction of the spring force (at this time, the pressure difference between the head portion and the tail portion of the pin is ΔPa). When the variable-capacity vane is pushed into the sliding vane groove of the variable-capacity cylinder to a certain position under the rotation of the roller, the pin enters the pin groove on the variable-capacity sliding vane to restrain the movement of the variable-capacity sliding vane; and thereafter the variable-capacity vane is disengaged from the roller, and the pressure in the variable-capacity cylinder continues to increase until the pressure is equal to the high pressure in the housing, then the switching process ends, and the variable-capacity cylinder assembly enters the idling mode.

In a more optional specific example, the switching process of the variable-capacity cylinder assembly from the idling mode to the normal working mode may include:

the variable-capacity cylinder assembly is in an idling state when the pressure in the variable-capacity cylinder is at a high pressure and the pressure is equal to the pressure in the housing. The pressure in the variable-capacity cylinder is gradually decreased through the variable-capacity assembly until the applied gas force is sufficient to overcome the spring force and the pin is pushed away from the variable-capacity sliding vane (the pressure difference between the head portion and the tail portion of the pin at this time is ΔPa); the restraint applied on the variable-capacity sliding vane is released; meanwhile because the pressure in the variable-capacity cylinder is decreased and the pressure difference between the head portion and the tail portion of the sliding vane is still ΔPa, the generated gas force pushes the variable-capacity sliding vane to move in a direction closer to the roller until the variable-capacity sliding vane fits the roller. At this time, the variable-capacity cylinder assembly starts intake and compressing; and the compressor power starts increasing accordingly, till when the pressure in the variable-capacity cylinder is equal to the pressure at the dispenser intake port, the check valve is turned on and the switching process ends; then the variable-capacity cylinder assembly enters the normal working mode.

Therefore, a pin groove is provided for facilitation of the mounting of the pin and facilitation of the control of the variable-capacity sliding vane by the pin and the pin spring. The mounting is firm and the reliability of the control is high.

Optionally, the sliding vane restraint unit 8 may include a magnetic element restraint unit. The magnetic element restraint unit may include a magnetic element 22.

In an optional specific example, the magnetic element 22 is provided at the tail portion of the variable-capacity sliding vane 5 in the variable-capacity cylinder assembly, and can be configured to attract the variable-capacity sliding vane 5 to make the variable-capacity sliding vane move toward the magnetic element 22.

Figure 4:
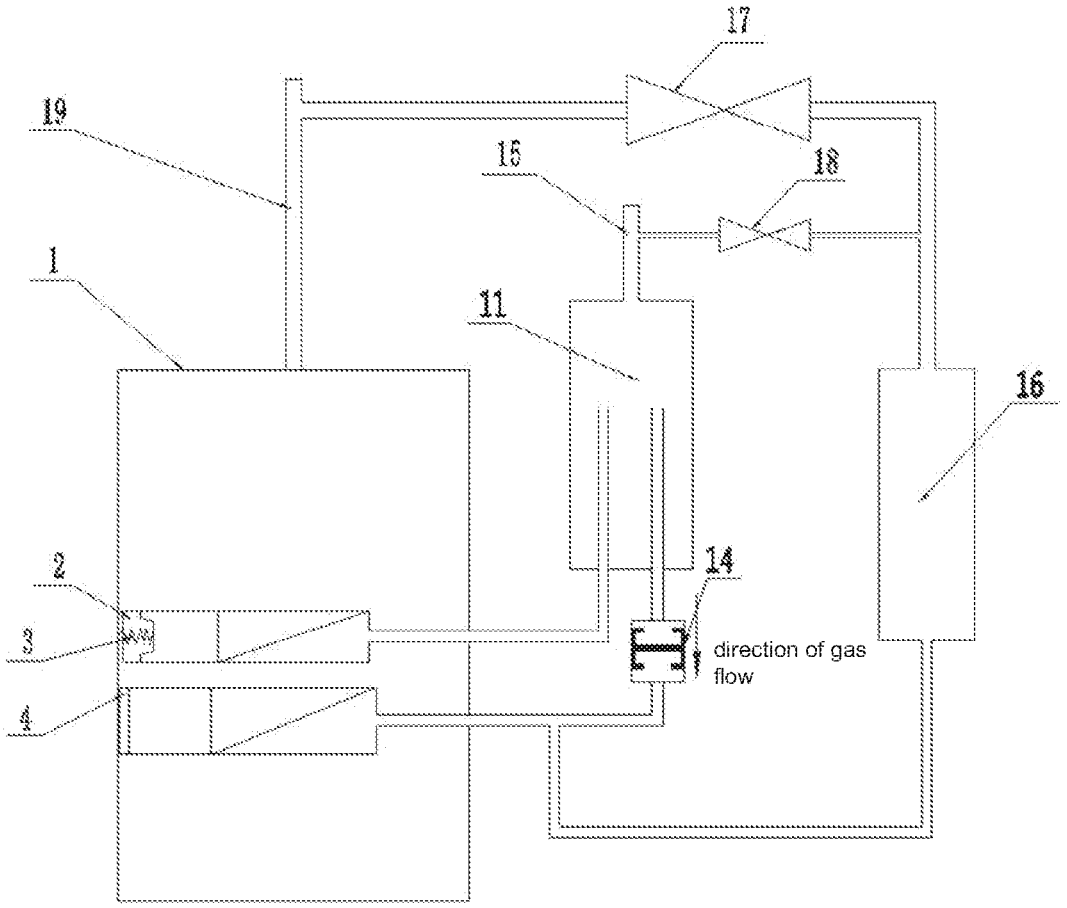
FIG. 4 is a schematic structure diagram illustrating a magnetic element restraint structure according to an embodiment of the present disclosure.
Figure 5:
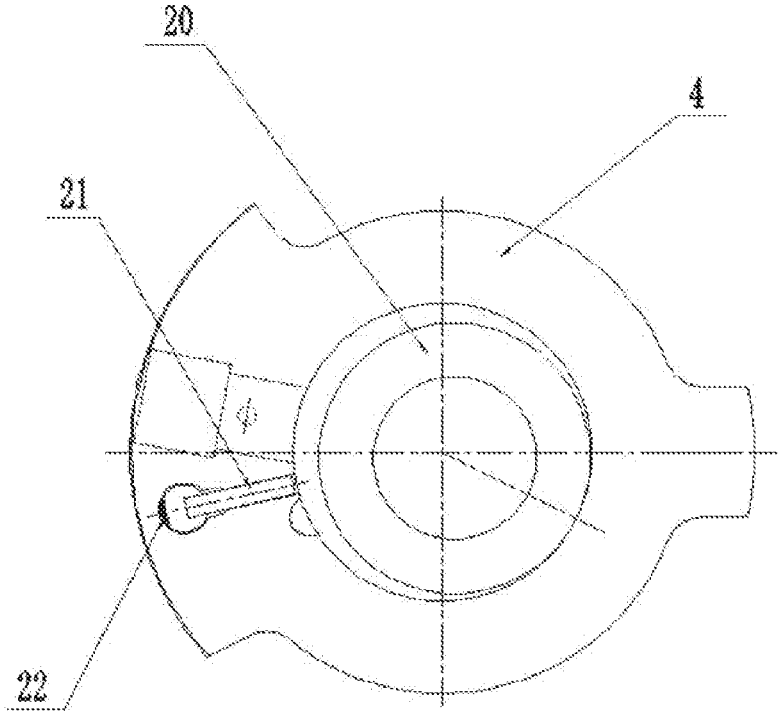
FIG. 5 is a schematic structure diagram illustrating a state in which a variable-capacity sliding vane is disengaged form a roller according to another embodiment.

For example, the magnetic element restraint unit is introduced in an embodiment II shown in FIGS. 4 and 5. The sliding vane restraint unit may consist of a magnetic element (for example, the magnetic element 22) provided at the tail portion of the variable-capacity sliding vane.

The magnetic element is fixed at the tail portion of the sliding vane groove of the variable-capacity cylinder, and has a magnetic force that attracts the variable-capacity sliding vane and makes the variable-capacity sliding vane have a tendency to move toward the magnetic element.

In a more optional specific example, the switching process of the variable-capacity cylinder assembly from the normal working mode to the idling mode may include:

when the pressure in the variable-capacity cylinder is at a low pressure and the pressure is equal to the pressure at the dispenser intake port, the variable-capacity cylinder assembly is in a normal working state. By gradually increasing the pressure inside the variable-capacity cylinder in the variable-capacity cylinder assembly, the check valve is closed until the pressure in the variable-capacity cylinder is increased to an extent such that the magnetic element is sufficient to overcome the gas force generated by the variable-capacity sliding vane due to the pressure difference (at this time the pressure difference between the head portion and the tail portion of the variable-capacity sliding vane is ΔPb); the variable-capacity sliding vane is pushed into the sliding vane groove of the variable-capacity cylinder by the rotating roller, and is restrained in the sliding vane groove by the magnetic force generated by the magnetic element; after that, the pressure continues to increase to be equal to the pressure in the housing, the switching process ends, and the variable-capacity cylinder assembly enters the idling mode.

In a more optional specific example, the switching process of the variable-capacity cylinder assembly from the idling mode to the normal working mode may include:

the variable-capacity cylinder assembly is in an idling state when the pressure in the variable-capacity cylinder is at a high pressure and the pressure is equal to the pressure in the housing; the pressure in the variable-capacity cylinder is gradually decreased through the variable-capacity assembly until the pressure in the variable-capacity cylinder is decreased to an extent such that the gas force generated by the variable-capacity sliding vane due to the pressure difference between the head portion and the tail portion of the variable-capacity sliding vane is sufficient to overcome the magnetic force applied by the magnetic element on the variable-capacity sliding vane (at this time, the pressure difference between the head portion and the tail portion of the variable-capacity sliding vane is ΔPb); the variable-capacity sliding vane is free from the restraint of the magnetic element, and moves toward the roller under the action of the gas force till the variable-capacity sliding vane fits the roller; the space inside the variable-capacity assembly is divided into a space on an intake side and a space on an exhaust side. The pressure on the intake side of the variable volume cylinder continues to decrease to make the compressor power gradually increase till the pressure on the intake side of the variable-capacity cylinder is equal to the pressure at the dispenser intake port, the check valve is turned on and the switching process ends; then the variable-capacity cylinder assembly enters the normal working mode.

Therefore, the variable-capacitance sliding vane is restrained through the magnetic element. The structure is simple, and the control mode is simple and convenient.

Optionally, the sliding restraint unit 8 may include a sliding vane restraint hole restraint unit. The sliding vane restraint hole restraint unit may include: a sliding vane restraint hole 23.

In an optional specific example, the sliding vane restraint hole 23 is located in a direction at a setting angle to the moving direction of the variable-capacity sliding vane 5 in the variable-capacity cylinder assembly, and is provided on one side of the variable-capacity cylinder 4 in the variable-capacity cylinder assembly opposite to the variable-capacity cylinder intake port 10 of the variable-capacity cylinder 4; the sliding vane restraint hole 23 can be configured to introduce the high-pressure gas in the housing 1 to the variable-capacity sliding vane groove side of the variable-capacity sliding vane 5, and communicate with the variable-capacity sliding vane groove. One side of the variable-capacity cylinder 4 in the variable-capacity cylinder assembly opposite to the variable-capacity cylinder intake port 10 of the variable-capacity cylinder 4 is one side of the variable-capacity cylinder 4 far from the variable-capacity cylinder intake port 10.

Therefore, the variable-capacity sliding vane is restrained through the sliding vane restraint hole, the restraint mode is simple, and the restraint reliability is high, thereby improving the flexibility and convenience of the sliding vane restraint, and also improving the applicability and universality of the compressor.

More optionally, in the sliding vane restraint hole restraint unit, the sliding vane restraint hole 23 introduces the high pressure gas of the housing 1 to the variable-capacity sliding vane groove side of the variable-capacity sliding vane 5, to form the pressure acting on the variable-capacity sliding vane 5, such that the variable-capacity sliding vane 5 fits the other side of the variable-capacity sliding vane groove tightly.

In a more optional specific example, the direction of the pressure is perpendicular to the direction of the linear movement of the variable-capacity sliding vane 5 and makes a frictional force generated between the variable-capacity sliding vane 5 and the tightly fitted side of variable-capacity sliding vane groove, to prevent the movement of the variable-capacity sliding vane 5.

Figure 6:
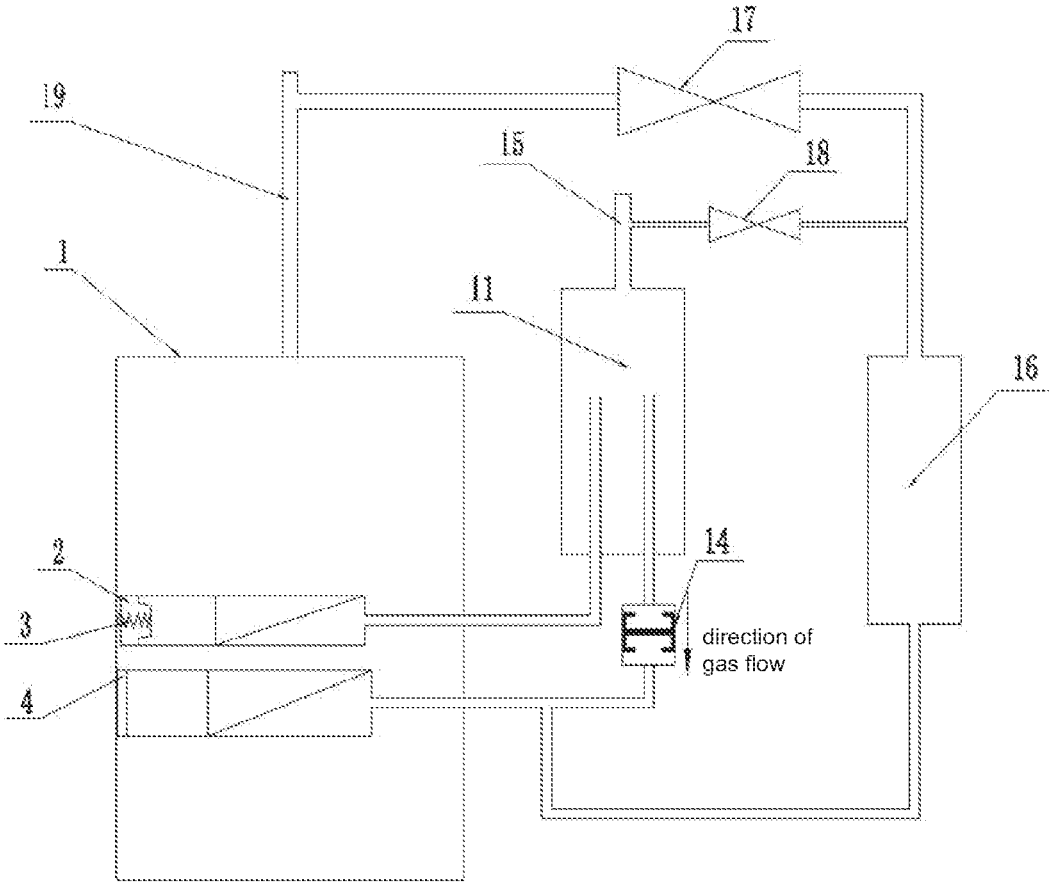
FIG. 6 is a schematic structure diagram illustrating a structure of a sliding vane restraint hole according to an embodiment of the present disclosure.
Figure 7:
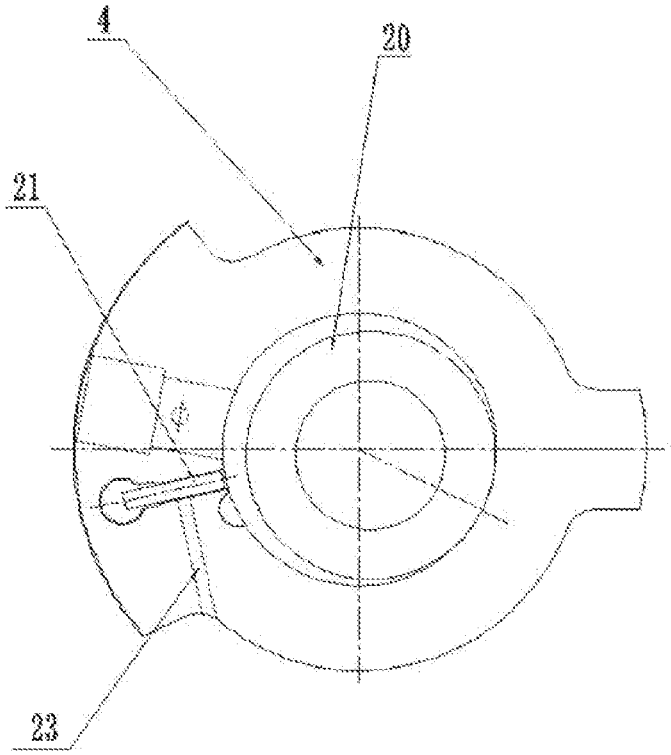
FIG. 7 is a schematic structure diagram illustrating a state in which a variable-capacity sliding vane is disengaged from a roller according to another embodiment.

For example, the structure of the sliding vane restraint hole restraint unit is described in an embodiment III shown in FIG. 6 and FIG. 7. In a direction at a certain angle to the moving direction of the variable-capacity sliding vane, a sliding vane restraint hole (for example, the sliding vane restraint hole 23) is provided on the side of the variable-capacity cylinder away from the intake port, and introduces the high pressure in the housing to the variable-capacity sliding vane groove side and communicates with the variable-capacity sliding vane groove.

The pressure generated by the introduced high pressure acts on the variable-capacity sliding vane to make the variable-capacity sliding vane fit the other side of the variable-capacity sliding vane groove tightly. The direction of the pressure is perpendicular to the linear movement direction of the variable-capacity sliding vane, thereby causing a frictional force generated between the variable-capacity sliding vane and the tightly fitted side of the variable-capacity cylinder sliding vane groove, and the frictional force has a tendency to prevent the movement of the variable-capacity sliding vane.

In a more optional specific example, the switching process of the variable-capacity cylinder assembly from the normal working mode to the idling mode may include:

when the pressure in the variable-capacity cylinder is at a low pressure and the pressure is equal to the pressure at the dispenser intake port, the variable-capacity cylinder assembly is in the normal working state. The pressure at the intake side of the variable-capacity cylinder is gradually increased through the variable-capacity assembly until the frictional force generated by the sliding vane restraint hole on the variable-capacity sliding vane is sufficient to overcome the gas force generated by the variable-capacity sliding vane due to the pressure difference (at this time the pressure difference between the head portion and the tail portion of the variable-capacity sliding vane is $\Delta Pc$); the variable-capacity sliding vane is pushed into the variable-capacity cylinder sliding vane groove and is restrained in the variable-capacity cylinder sliding vane groove by the frictional force; thereafter, the pressure continues to increase to be equal to the pressure in the housing, then the switching process ends, and the variable-capacity cylinder assembly enters the idling state.

In a more optional specific example, the switching process of the variable-capacity cylinder assembly from the idling mode to the normal working mode may include:

when the pressure in the variable-capacity cylinder is at a high pressure and is equal to the pressure in the housing, the variable-capacity cylinder assembly is in an idling state. The pressure in the variable-capacity cylinder is gradually decreased through the variable-capacity assembly until the pressure in the variable-capacity cylinder is decreased to an extent such that the gas force generated by the variable-capacity sliding vane dues to the pressure difference between the head portion and the tail portion of the variable-capacity sliding vane is sufficient to overcome the frictional force on the sliding vane generated by the high pressure introduced by the sliding vane restraint hole (at this time, the pressure difference between the head portion and the tail portion of the variable-capacity sliding vane is $\Delta Pb$), the variable-capacity sliding vane is free from the restraint of the frictional force and moves toward the roller under the action of the gas force till it fits the roller; the space in the variable-capacity assembly is divided into a space on an intake side and a space on an exhaust side. The pressure on the intake side of the variable-capacity cylinder continues to decrease to make the compressor power gradually increase, till the pressure on the intake side of the variable-capacity cylinder is equal to the pressure at the dispenser intake port, then the check valve is turned on and the switching process ends, the variable-capacity cylinder assembly enters the normal working mode.

Therefore, the restraint is performed by means of the frictional force formed by the variable-capacity sliding vane under the pressure introduced by the sliding vane restraint hole, the structure is simpler, the control mode is simpler and more convenient, and reliability can be guaranteed.

After a large number of tests and verifications, by adopting the technical solution of the present embodiment and by controlling the variable-capacity assembly to act orderly, the vibration of the compressor during the mode switching is significantly reduced, and problems such as shutdown and pipeline break during the mode switching of the compressor are avoided.

According to an embodiment of the present disclosure, a compressor corresponding to a variable-capacity control structure is further provided. The compressor may include at least one compression cylinder assembly operating constantly. The compressor may further include at least one variable-capacity cylinder assembly capable of being selectively in an operating state or an idling state. The variable-capacity cylinder assembly may include the variable-capacity control structure described above.

For example, the compression cylinder assembly of the compressor may include at least one compression cylinder assembly operating constantly and at least one compression cylinder assembly capable of selectively working or idling (denoted as a variable-capacity cylinder assembly to show the difference).

In an alternative embodiment, the roller-rotor compressor may include: a compression cylinder assembly operating constantly and a variable-capacity cylinder assembly capable of selectively performing normal working or idling; witching of the working mode of the variable-capacity cylinder is implemented by the combined action of an external variable-capacity assembly and a sliding vane restraint unit; the variable-capacity assembly includes a check valve provided between the variable-capacity cylinder intake port and the second dispenser outlet, a low-pressure side control pipe drawn from the dispenser intake port and a second solenoid valve, a high-pressure side control pipe drawn from the exhaust pipe (or a position with the pressure equal to the pressure in the housing) and a first solenoid valve, a common side connection pipe drawn from a position between the variable-capacity cylinder intake port and the check valve, and a buffer connected to the common side connection pipe; the high-pressure side control pipe and the low-pressure side control pipe are connected to the common side control pipe, to enable the common side control pipe to introduce the high pressure in the housing (for example, the housing 1) into the variable-capacity cylinder intake port or introduce the high pressure in the variable-capacity cylinder and the buffer into the dispenser.

Compared to the variable-capacity cylinder assembly, the compression cylinder assembly operating constantly is a constant-capacity cylinder assembly. For example, the constant-capacity cylinder assembly may include an invariable-capacity cylinder 2 and a pump spring 3. The constant-capacity cylinder assembly is in communication with the first dispenser outlet 12 of the dispenser 11.

For example, if the volume (i.e., displacement) of the gas discharged by rotating the constant-capacity assembly in one circle is $V_a$, the volume of gas discharged by rotating the variable-capacity cylinder assembly in one circle is $V_b$. When the compressor is in the operating state, the displacement of the constant-capacity cylinder assembly can only be $V_a$, but the displacement of the variable-capacity cylinder assembly can be $V_b$ or 0 (depending on the operating mode of the compressor).

In an optional example, the first solenoid valve has the capability to adjust the flow area, and its adjustment range can be gradually adjusted from 0 (that is, completely closed) to the maximum.

Optionally, the first solenoid valve is required to have a characteristic of adjustable flow area. The electronic expansion valve currently used for throttling in the air conditioners has the characteristic of adjustable flow area.

Optionally, the maximum flow area $S_1$ of the first solenoid valve satisfies $S_1 \geq 0.01147$ fV, with the unit $mm^2$. Where, f is the maximum allowable operating frequency when switching the mode of the variable-capacity cylinder assembly, and V is the working volume of the variable-capacity cylinder during normal working with the unit $cm^3$.

Alternatively, the first solenoid valve may be replaced with an electronic expansion valve.

In an optional example, the second solenoid valve has a completely closed state and an open state, and the maximum allowable flow area $S_2$ when the second solenoid valve is opened satisfies $S_2 \leq 0.587V$ with the unit $mm^2$. Where, V is the working volume of the variable-capacity cylinder during normal working, with the unit $cm^3$.

Optionally, the second solenoid valve can also be a valve that can be manually controlled to open and close, but the valve cannot implement automatic control, the operation is inconvenient.

In an alternative example, the volume $V_h$, of the gas that the buffer can hold satisfies $V_h \geq 10V$.

Optionally, a transition region is set between the working mode and the idling mode of the variable-capacity cylinder, and the time duration $T_1$ of the transition region satisfies $T_1 \geq 5$ seconds.

Optionally, a transition region is set between the idling mode and the working mode of the variable-capacity cylinder, and the time duration $T_2$ of the transition region satisfies $T_2 \geq 10$ seconds.

In an optional example, the switching process of the variable-capacity cylinder from the working mode to the idling mode includes:

(1) the second solenoid valve is closed (if the second solenoid valve was in the closed state before, the second solenoid valve continues to maintain the closed state);

(2) the flow area of the first solenoid valve gradually increased from 0 to the maximum value $S_1$, with the time duration $T_1$;

(3) after the switching process is completed, the state of the first solenoid valve can be in a state with a flow area of 0 or the maximum value $S_1$, and the second solenoid valve continuously maintains the closed state.

In an optional example, the switching process of the variable-capacity cylinder from idling mode to working mode includes:

(1) the open of the first solenoid valve is controlled to increase the flow area to the maximum value $S_1$;

(2) the second solenoid valve is switched from the closed state to the open state, with the maximum allowed flow area $S_2$;

(3) the flow area of the first solenoid valve is gradually decreased from the maximum value $S_1$ to 0, with the time duration $T_2$;

(4) after the completion of the switching, the flow section of the first solenoid valve is 0 (that is, in the completely closed state), while the second solenoid valve continues to maintain the open or closed state.

In an alternative embodiment, the compressor in the present disclosure may include: a rolling-rotor refrigeration compressor. The rolling-rotor refrigeration compressor may include a housing, a motor, and a pump body. The motor and the pump body are coaxially and hermetically arranged in the housing.

Specifically, in the inner space of the housing, the motor is provided on the upper portion of the housing. The motor may include a stator and a rotor. The stator is annularly arranged in the housing, and the rotor is sleeved in the stator with a gap. The rotor and the pump body are connected as a whole by a crankshaft, and a rotating electromagnetic force generated by a coil provided on the stator is utilized to drive the rotor and the crankshaft to rotate.

In an optional example, a pump body assembly to which the pump body belongs has a plurality of compression cylinder assemblies which are hermetically separated by bearings. Each compression cylinder assembly may include: a cylinder, a roller (for example, the roller 20) sleeved on an eccentric portion of the crankshaft, and a sliding vane (for example, the sliding vane 21) which can slide linearly in the sliding vane groove of the cylinder and has one end contacting the roller.

Optionally, the above compression cylinder assembly may include: at least one compression cylinder assembly operating constantly and at least one compression cylinder assembly capable of selectively working or idling (referred to as a variable-capacity cylinder assembly to show the difference).

In an optional specific example, when the sliding vane in the variable-capacity cylinder (for example, the variable-capacity cylinder 4) contacts the roller, the space in the variable-capacity cylinder is divided into a space on a low-pressure intake side and a space on a high-pressure exhaust side, volumes of which vary with the rotation angle. The crankshaft rotates to compress the gas inhaled into the variable-capacity cylinder, and the variable-capacity cylinder is in the normal working state at this time.

In an optional specific example, when the sliding vane in the variable-capacity cylinder returns into the sliding vane groove and is restrained in the sliding vane groove by a sliding vane restraint unit provided in the pump body, the sliding vane is separated from the roller, and only one chamber is left in the variable-capacity cylinder and the only one chamber communicates with the variable-capacity cylinder intake side. When the crankshaft rotates, the gas in the variable-capacity assembly is no longer compressed, and the variable-capacity cylinder is in the idling state at this time.

The working mode (for example, working state, idling state, etc.) of the variable-capacity cylinder assembly is determined by the combined action of the variable-capacity assembly provided outside the housing and the sliding vane restraint unit provided in the pump body.

More optionally, the variable-capacity assembly may include a check valve (for example, the check valve 14) provided between the variable-capacity cylinder intake port (for example, the variable-capacity cylinder intake port 10) and the second dispenser outlet (for example, the second dispenser outlet 13).

In a more optional specific example, when the refrigerant has a tendency of flowing from the second dispenser outlet to the variable-capacity cylinder intake port, the check valve is in an on state.

In a more optional specific example, when the refrigerant has a tendency of flowing from the variable-capacity cylinder intake port to the second dispenser outlet, the check valve is in the closed state, that is, the check valve has characteristics of forward guide and reverse cutoff.

Furthermore, the variable-capacity assembly may further include: a pipe drawn from the inside of the housing (for example, the housing 1) (for example, from the compressor exhaust port, i.e., the high-pressure exhaust side 28) and high-pressure side control pipe (for example, the exhaust pipe 19) connected to the first solenoid valve (for example, the first solenoid valve 17), a pipe drawn from the low-pressure intake side (for example, the low-pressure intake side 27) and a low-pressure-side control pipe (for example, the low-pressure-side control pipe 29) connected to the second solenoid valve (for example: the second solenoid valves 18), and a common connection pipe (for example, the common connection pipe 30) drawn from a place between the variable-capacity cylinder intake port and the check valve.

The common connection pipe respectively communicates with the other end of the high-pressure side control pipe and the other end of the low-pressure side control pipe (for example, see the examples shown in FIGS. 1 to 3, 4 to 5, and 6 to 7).

In such a way, the low-pressure refrigerant or high-pressure refrigerant can be selectively introduced between the check valve and the variable-capacity cylinder intake port. Specifically, when the second solenoid valve is turned on and the first solenoid valve is closed, the low-pressure refrigerant can be introduced there, and at this time, the check valve is in an on state; when the first solenoid valve is turned on and the second solenoid valve is closed, the high-pressure refrigerant can be introduced there, and the check valve is in the closed state at this time.

More optionally, the sliding vane restraint unit (for example, the sliding vane restraint unit 8) may have the following three forms of structure.

(1) the structure of the pin restraint unit is described through the embodiment I as shown in FIGS. 1 to 3.

The sliding vane restraint unit may include a pin (for example, the pin 6) provided in a vertical direction of a variable-capacity sliding vane (for example, variable capacity slide 5) in a variable-capacity cylinder assembly, and a spring (for example, the pin spring 7) provided at the tail portion of the pin.

One end of the variable-capacity sliding vane is close to the roller (e.g., the roller 20) in the radial direction of the cylinder, which is referred to as the sliding vane head portion, such as the sliding vane head portion 24; and the other end of the variable-capacity sliding vane is away from the roller, which is referred to as the sliding vane tail portion, such as the sliding vane tail portion 25. The variable-capacity sliding vane is restrained by the bearings on both sides in the axial direction of the cylinder, and is provided with a pin groove (for example, the pin groove 26) on the side near the pin.

Specifically, the pin is provided in a bearing adjacent to the variable-capacity cylinder, one end of the pin is close to the variable-capacity sliding vane (referred to as a pin head portion), and the other end of the pin is far from the variable-capacity sliding vane (referred to as a pin tail portion). The sliding vane tail portion and the pin head portion communicate with the high pressure inside the housing. The pressure on the sliding vane head portion is the same as the pressure in the variable-capacity cylinder. The pin tail portion is connected to the variable-capacity cylinder intake port through the pin communication channel (for example, the pin communication channel 9) inside the pump body.

In a more optional specific example, the switching process of the variable-capacity cylinder assembly from the normal working mode to the idling mode may include:

when the pressure in the variable-capacity cylinder is at a low pressure and is equal to the pressure at the dispenser intake port, the variable-capacity cylinder assembly is in the normal working state. The pressure on the intake side of the variable-capacity cylinder is gradually increased through the variable-capacity assembly until the spring at the tail portion of the pin is sufficient to overcome the gas force with a direction opposite to the direction of the spring force (at this time, the pressure difference between the head portion and the tail portion of the pin is $\Delta Pa$); when the variable-capacity sliding vane is pushed into the variable-capacity cylinder sliding vane groove to a certain position under the rotation of the roller, the pin enters the pin groove on the variable-capacity sliding vane to restrain the movement of the variable-capacity sliding vane; after that, the variable-capacity sliding vane is disengaged from the roller, and the pressure in the variable-capacity cylinder continues to increase till the pressure is equal to the high pressure in the housing, then the switching process ends, and the variable-capacity cylinder assembly enters the idling mode.

In a more optional specific example, the switching process of the variable-capacity cylinder assembly from the idling mode to the normal working mode may include:

when the pressure in the variable-capacity cylinder is at a high pressure and is equal to the pressure in the housing, the variable-capacity cylinder assembly is in the idling state. The pressure in the variable-capacity cylinder is gradually decreased through the variable-capacity assembly until the applied gas force is sufficient to overcome the spring force and push the pin away from the variable-capacity sliding vane (the pressure difference between the head portion and the tail portion of the pin at this time is ΔPa), the restraint applied on the variable-capacity sliding vane is released; and meanwhile because the pressure in the variable-capacity cylinder is decreased and the pressure difference between the head portion and the tail portion of the sliding vane is also ΔPa, the resulting gas force pushes the variable-capacity sliding vane to move toward the roller till the variable-capacity sliding vane fits the roller. At this time, the variable-capacity cylinder assembly starts to inhale and compress, and the compressor power starts to increase accordingly till the pressure in the variable-capacity cylinder is equal to the pressure at the dispenser intake port, the check valve is turned on and the switching process ends, then the variable-capacity cylinder assembly enters the normal working mode.

(2) Magnetic element restraint unit is described through an embodiment II as shown in FIGS. 4 and 5.

The sliding vane restraint unit mainly consists of a magnetic element (for example, the magnetic element 22) provided at the tail portion of the variable-capacity sliding vane.

The magnetic element is fixed at the tail portion of the variable-capacity cylinder sliding vane groove, and has a magnetic force that attracts the variable-capacity sliding vane to make the variable-capacity sliding vane have a tendency moving toward the magnetic element.

In a more optional specific example, the switching process of variable-capacity cylinder assembly from the normal working mode to the idling mode may include:

when the pressure in the variable-capacity cylinder is at a low pressure and is equal to the pressure at the dispenser intake port, the variable-capacity cylinder assembly is in the normal working state. The pressure in the variable-capacity cylinder in the variable-capacity cylinder assembly is gradually increased, the check valve is closed until the pressure in the variable-capacity cylinder is increased to an extent such that the magnetic element is sufficient to overcome the gas force generated by the variable-capacity sliding vane due to the pressure difference (at this time the pressure difference between the head portion and the tail portion of the sliding vane is ΔPb). The variable-capacity sliding vane is pushed into the variable-capacity cylinder sliding vane groove by the rotating roller, and is restrained in the sliding vane groove by the magnetic force generated by the magnetic element; after that, the pressure continues to increase to be equal to the pressure in the housing, the switching process ends, and the variable-capacity cylinder assembly enters the idling mode.

In a more optional specific example, the switching process of the variable-capacity cylinder assembly from the idling mode to the normal working mode may include:

when the pressure in the variable-capacity cylinder is at a high pressure and is equal to the pressure in the housing, the variable-capacity cylinder assembly is in the idling state. The pressure in the variable-capacity cylinder is gradually decreased through the variable-capacity assembly until the pressure in the variable-capacity cylinder is decreased to an extent such that the gas force generated by the variable-capacity sliding vane dies to the pressure difference between the head portion and the tail portion of the variable-capacity sliding vane is sufficient to overcome the magnetic force applied by the magnetic element on the variable-capacity sliding vane (at this time, the pressure difference between the head portion and the tail portion of the variable-capacity sliding vane is ΔPb), the variable-capacity sliding vane is free from the restraint of the magnetic element and moves toward the roller under the action of the gas force till the variable-capacity sliding vane fits the roller; then the space inside the variable-capacity cylinder assembly is divided into a space on an intake side and a space on an exhaust side. The pressure on the intake side of the variable-capacity cylinder continues to decrease to make the compressor power gradually increase, till the pressure on the intake side of the variable-capacity cylinder is equal to the pressure at the dispenser intake port, the check valve is turned on and the switching process ends, then the variable-capacity cylinder assembly enters the normal working mode.

(3) The structure of the sliding vane restraint hole restraint unit is described through an embodiment III as shown in FIG. 6 and FIG. 7.

In a direction at a certain angle to the moving direction of the variable-capacity sliding vane, a sliding vane restraint hole (for example, the sliding vane restraint hole 23) is provided on the side of the variable-capacity cylinder away from the intake port, and the high pressure in the housing is introduced to the variable-capacity sliding vane side and communicates with the variable-capacity sliding vane groove.

The pressure generated by the introduced high pressure acts on the variable-capacity sliding vane to make the variable-capacity sliding vane tightly fit the other side of the variable-capacity sliding vane groove. The direction of the pressure is perpendicular to the direction of the linear movement of the variable-capacity sliding vane, to make a frictional force generated between the variable-capacity sliding vane and the tightly fitted side of the variable-capacity cylinder sliding vane groove, and the frictional force has a tendency to prevent movement of the variable-capacity sliding vane.

In a more optional specific example, the switching process of the variable-capacity cylinder assembly from the normal working mode to the idling mode may include:

when the pressure in the variable-capacity cylinder is at a low pressure and is equal to the pressure at the dispenser intake port, the variable-capacity cylinder assembly is in the normal working state. The pressure on the intake side of the variable-capacity cylinder is gradually increased through the variable-capacity assembly until the frictional force generated by the sliding vane restraint hole on the variable-capacity sliding vane is sufficient to overcome the gas force generated by the variable-capacity sliding vane due to the pressure difference (at this time the pressure difference between the head portion and the tail portion of the variable-capacity sliding vane is ΔPc), the variable-capacity sliding vane is pushed into the variable-capacity cylinder sliding vane groove and is restrained in the variable-capacity cylinder sliding vane groove by the frictional force. Thereafter, the pressure continues to increase to be equal to the pressure in the housing, then the switching process ends, and the variable-capacity cylinder assembly enters the idling state.

In a more optional specific example, the switching process of the variable-capacity cylinder assembly from the idling mode to the normal working mode may include:

when the pressure in the variable-capacity cylinder is at a high pressure and is equal to the pressure in the housing, the variable-capacity cylinder assembly is in the idling state. The pressure in the variable-capacity cylinder is gradually decreased through the variable-capacity assembly until the pressure in the variable-capacity cylinder is decreased to an extent such that the gas force generated by the variable-capacity sliding vane dues to the pressure difference between the head portion and the tail portion of the variable-capacity sliding vane is sufficient to overcome the frictional force on the sliding vane generated by the high pressure introduced by the sliding vane restraint hole (at this time, the pressure difference between the head portion and the tail portion of the variable-capacity sliding vane is ΔPb), the variable-capacity sliding vane is free from the restraint of frictional force and moves toward the roller under the action of the gas force until the variable-capacity sliding vane fits the roller. The space in the variable-capacity assembly is divided into a space on an intake side and a space on an exhaust side. The pressure on the variable-capacity cylinder intake side continues to decrease to make the compressor power gradually increase until the pressure on the variable-capacity cylinder intake side is equal to the pressure at the dispenser intake port, the check valve is turned on and the switching process ends, then the variable-capacity cylinder assembly enters the normal working mode.

Further, the influence of the flow area $S_1$ of the first solenoid valve on the pressure in the variable-capacity cylinder when switching is described below.

(11) When the variable-capacity cylinder assembly is in the working mode, the pressure on the variable-capacity cylinder intake side is equal to the pressure on the dispenser intake port, the check valve is in an on state, the first solenoid valve is in a closed state, and the second solenoid valve is in an on state or closed state.

(12) At a certain time, when the variable-capacity cylinder assembly needs to be switched to the idling mode, the second solenoid valve is closed (if the second solenoid valve was in the on state before) and the first solenoid valve is opened. The high-pressure gas in the housing is introduced into the variable-capacity cylinder intake port to close the check valve and then flows into the variable-capacity cylinder intake side. The high-pressure gas when flowing through the first solenoid valve is restricted by the flow section, and a certain degree of pressure decrease occurs. If the high pressure is introduced at this time, the pressure drop is too large to make the sliding vane restraint unit restrain the variable-capacity sliding vane in the variable-capacity cylinder sliding vane groove and make the variable-capacity sliding vane disengage from the roller; the variable-capacity cylinder assembly turns to compress and discharge the gas that flows from the housing through the high-pressure side control pipe and is introduced into the variable-capacity cylinder intake side. At this time, the pressure on the intake side of the variable-capacity cylinder is further decreased, but its pressure is higher than the pressure in the dispenser, the check valve is maintained in the closed state, and the current of the compressor is decreased to a certain extent compared to the current before the switching operation.

Figure 14:
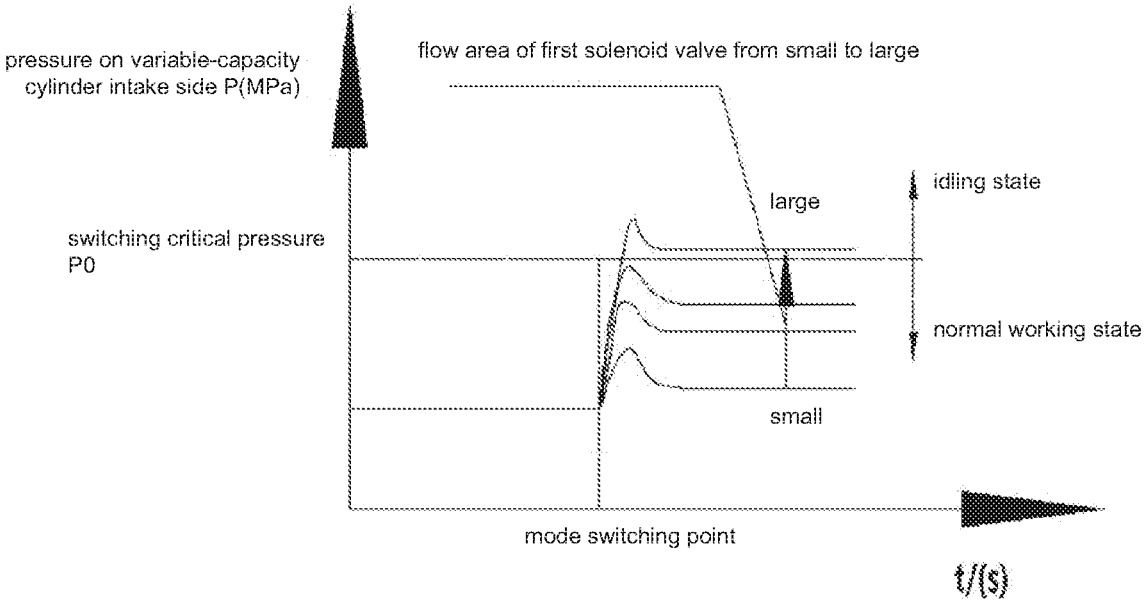
FIG. 14 is a schematic curve diagram illustrating a working state of a variable-capacity cylinder assembly and a pressure change tendency on a intake side with an increase of a flow area of a first solenoid valve according to an embodiment of the present disclosure.
Figure 15:
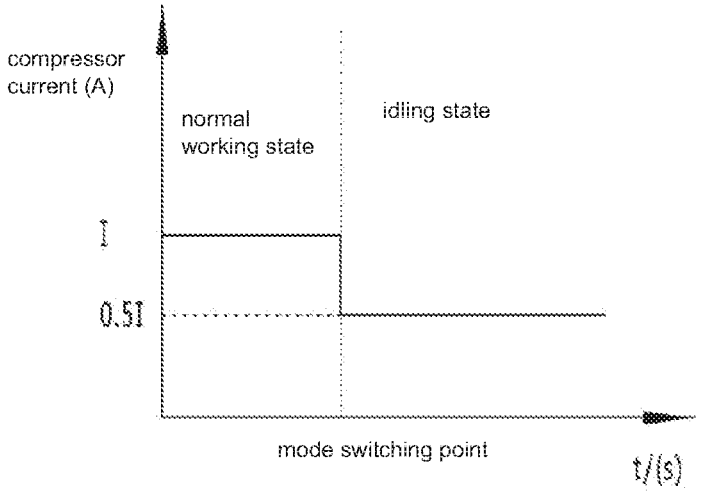
FIG. 15 is a sequence diagram of a compressor current when a conventional two-cylinder compressor is switched to a conventional single-cylinder compressor.
Figure 16:
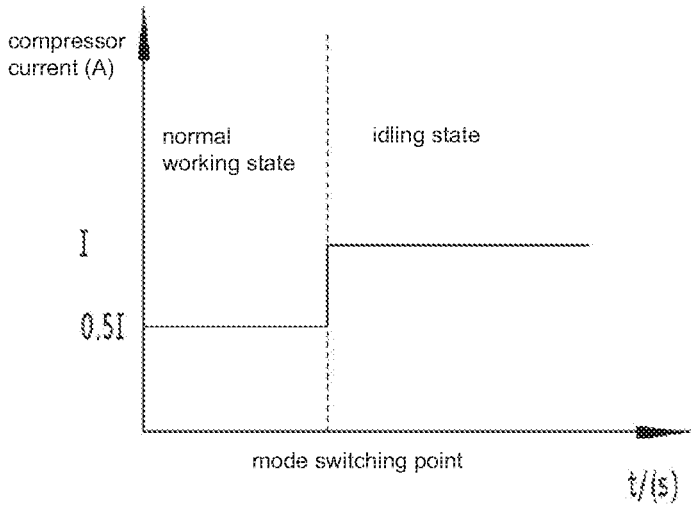
FIG. 16 is a sequence diagram of a compressor current when a conventional single-cylinder compressor is switched to a conventional two-cylinder compressor.
Figure 17:
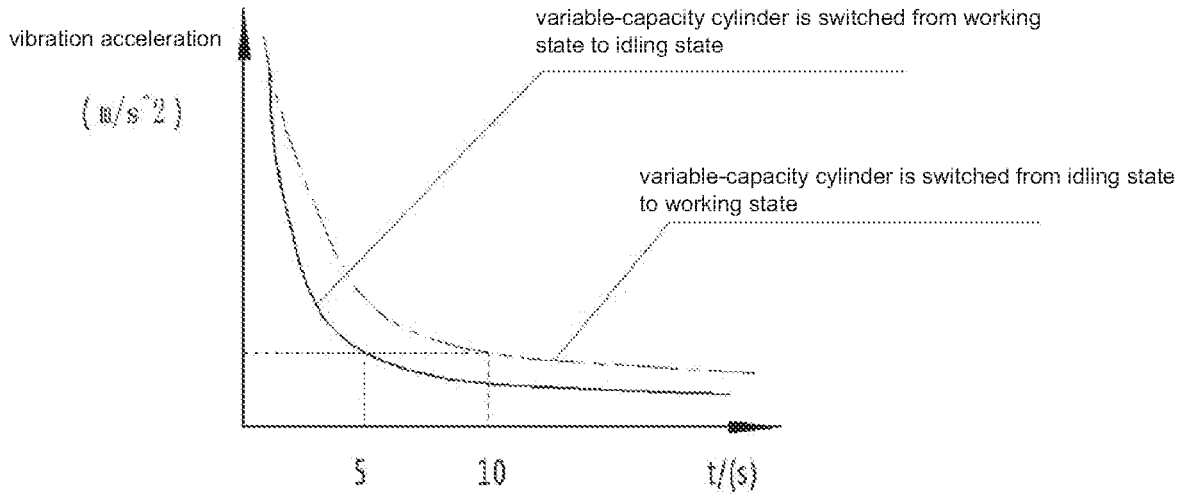
FIG. 17 is a schematic curve diagram illustrating a change rule of a maximum vibration acceleration of a compressor with a time duration of a transition region when a mode of a variable-capacity cylinder assembly is switched according to an embodiment of the present disclosure.
Figure 18:
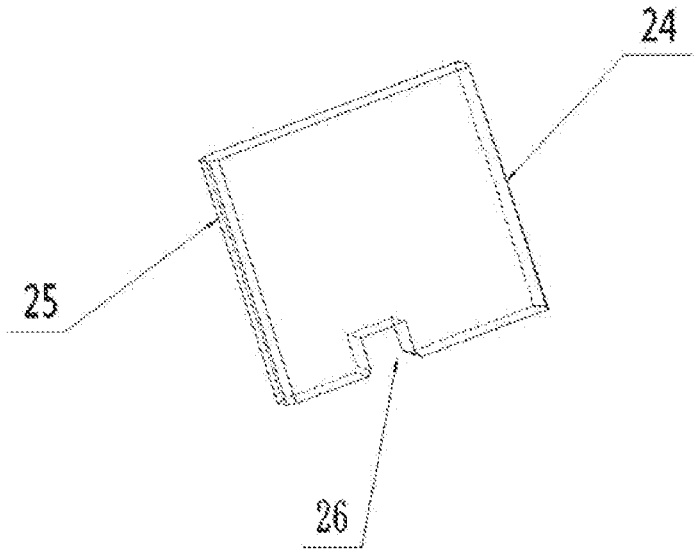
FIG. 18 is a schematic structure diagram illustrating a structure of a variable-capacity sliding vane according to an embodiment of the present disclosure.

(13) If the flow area of the first solenoid valve is gradually increased at this time, the pressure on the intake side of the variable-capacity cylinder is gradually increased until the sliding vane restraint unit has a condition of restraining the variable-capacity sliding vane; then the variable-capacity sliding vane is restrained in the variable-capacity cylinder sliding vane groove and disengaged from the roller; the pressure in the variable-capacity cylinder in increased to be equal to the pressure in the housing; the switching process ends, and the variable-capacity cylinder assembly is switched to the idling mode. When the flow area of the first solenoid valve is gradually increased, the pressure curve on the intake side of the variable-capacity cylinder is shown in FIG. 14.

The above phenomenon indicates that whether the variable-capacity cylinder can be successfully switched from the working mode to the idling mode is limited by the flow area S of the first solenoid valve. Through further tests, the condition of whether the variable-capacity cylinder can be switched from the working mode to the idling mode is that the flow area S of the first solenoid valve is greater than or equal to a critical flow area $S_0$, that is:

$S \geq S_0 = 0.0147\ fV$, with the unit $mm^2$. Where f is the operating frequency of the compressor during switching, and V is the working volume of the variable-capacity cylinder during the normal working with the unit $cm^3$.

If the flow area $S_1$ of the first solenoid valve has a characteristic of variable flow area from 0 (that is, the first solenoid valve is in the closed state) to $S_0$, when the variable-capacity cylinder assembly is switched from the normal working mode to the idling mode, the maximum value of the flow area of the first solenoid valve is gradually increased and the pressure in the variable-capacity cylinder is also gradually increased, and the compressor current is gradually decreased until the compressor current reaches the minimum value. The speed of the flow area S1 of the first solenoid valve increasing from 0 (that is, the first solenoid valve is in the closed state) to the maximum is properly controlled, and the time duration $T_1$ for the variable-capacity cylinder assembly to switch from the normal working mode to the idling mode is extended, which make the vibration to the compressor during the switching process is significantly reduced, thereby improving the reliability of switching of the compressor.

Further, the influence of the flow area S2 of the second solenoid valve on the pressure in the variable-capacity cylinder during switching is described below.

(21) When the variable-capacity cylinder is in the idling mode, the pressure in the variable-capacity cylinder is a high pressure and is equal to the pressure in the housing; the state of the variable-capacity assembly includes: the check valve is closed, the second solenoid valve is closed, and the first solenoid valve is opened or closed; the variable-capacity sliding vane is restrained in the variable-capacity cylinder sliding vane groove by the sliding vane restraint unit.

(22) At a certain time, when the variable-capacity cylinder assembly needs to be switched to the normal working state, the first solenoid valve (if it was in the open state before) is closed and the second solenoid valve is opened, the high-pressure gas in variable-capacity cylinder flows into the dispenser intake port along the common side connection pipe and the low-pressure side connection pipe. The gas flow (the volume of gas flowing in a unit time) flowing into the dispenser intake port from the variable-capacity cylinder is limited by the flow area of the second solenoid valve. Because the gas in a space between the variable-capacity cylinder and the second solenoid valve is decreased, the pressure is gradually decreased. When the pressure is decreased to meet the condition under which the variable-capacity sliding vane is free from the restraint of the sliding vane restraint unit, the variable-capacity sliding vane moves toward the roller under the action of the gas force until the head portion of the variable-capacity sliding vane fits the roller.

(23) The variable-capacity cylinder assembly starts to compress and discharge the remaining gas in the variable-capacity cylinder. The pressure in the variable-capacity cylinder is decreased as the remaining gas is reduced. If the flow area of the second solenoid valve is too large, the amount of the remaining gas is decreased faster, and the load of the variable-capacity cylinder assembly is increased rapidly. The compressor is subjected to huge vibrations due to sudden increase of the load, which may cause the compressor to stop suddenly or even the compressor connection pipeline to be broken. Thus, it is necessary to limit the flow area $S_2$ of the second solenoid valve. After testing, the flow area $S_2$ of the second solenoid valve should meet the following conditions:

$S2 \leq 0.587V$, with the unit $mm^2$. Where, V is the working volume of the variable-capacity cylinder, and $S_2$ is smaller than the maximum flow area of the first solenoid valve.

In order to further slow down the pressure decrease in the variable-capacity cylinder when switching from the idling mode to the working mode, a buffer (for example, the buffer 16) is provided between the variable-capacity cylinder intake port and the second solenoid valve, and the volume of gas that the buffer can hold satisfies $V_h \geq 10V$, and V is the working volume of the variable-capacity cylinder.

When the variable-capacity assembly is switched from the working mode to the idling mode, the action processes of the first solenoid valve and the second solenoid valve may be as follows.

Figure 11:
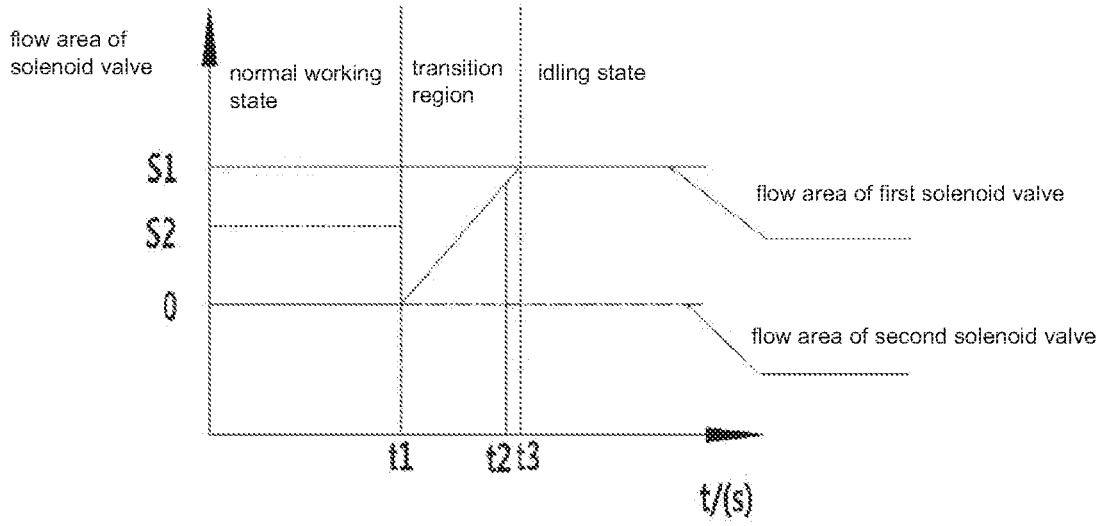
FIG. 11 is a sequence diagram of a solenoid valve flow area when a variable-capacity cylinder assembly is switched from a normal working state into an idling state according to embodiment of the present disclosure.

(31) As shown in FIG. 11, when the variable-capacity cylinder assembly is in the working state (also referred to as a working mode), the first solenoid valve is in the closed state (that is, the flow area is 0), and the second solenoid valve is in the open state (that is, the flow area is $S_2$; in order to save power, at this time the second solenoid valve is maintained in the closed state).

Figure 12:
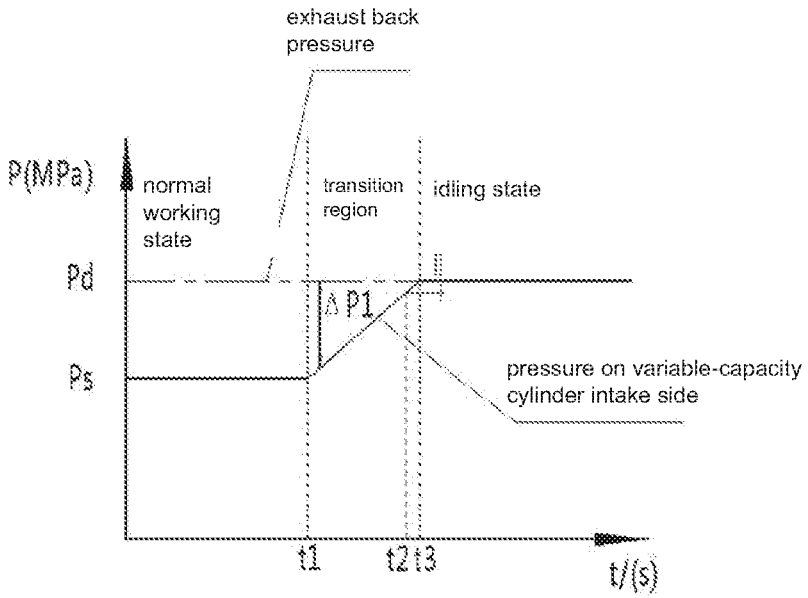
FIG. 12 is a sequence diagram of a pressure on a intake side of a variable-capacity cylinder when the variable-capacity cylinder assembly is switched from a normal working state into an idling state according to an embodiment of the present disclosure.
Figure 13:
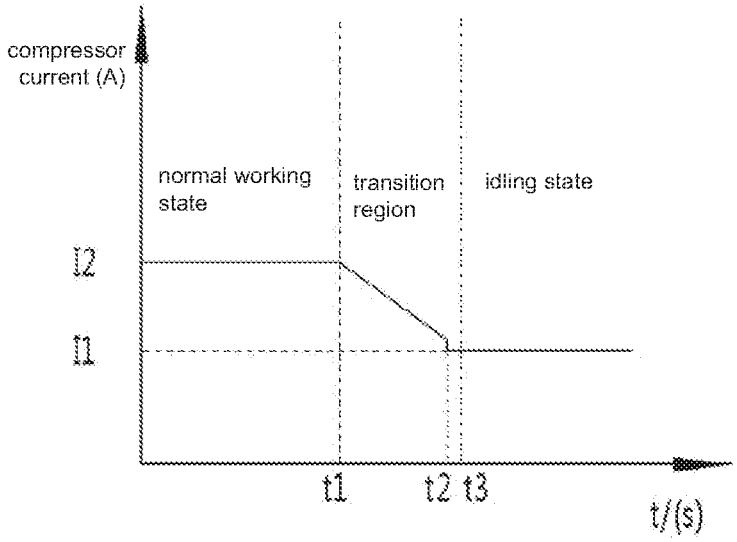
FIG. 13 is a sequence diagram of a compressor current when a variable-capacity cylinder assembly is switched from a normal working state into an idling state according to an embodiment of the present disclosure.

(32) At the moment t1, when the variable-capacity cylinder assembly needs to be switched from the working state to the idling state, the second solenoid valve is in the closed state (that is, the flow area is 0), and then the flow area of the first solenoid valve is gradually increased; the check valve is closed, the pressure on the intake side of the variable-capacity cylinder is gradually increased, and the differential pressure $\Delta P1$ between the exhaust back-pressure of the variable-capacity cylinder and the pressure on the intake side of the variable-capacity cylinder is gradually decreased (for example, see the example shown in FIG. 12); the compressor current is also decreased gradually (for example, see the example shown in FIG. 13).

(33) At the moment t2, the sliding vane restraint unit is provided with the condition of restraining the variable-capacity sliding vane (A $P1 \leq \Delta Pa$ for the embodiment I, $\Delta P1 \leq \Delta Pb$ for the embodiment II, and $\Delta P1 \leq \Delta Pc$ for the embodiment III), such that the variable-capacity sliding vane is disengaged from the roller; hereafter, the pressure in the variable-capacity cylinder is increased to be the same as the pressure in the housing (also referred to as an exhaust back pressure), the compressor current is decreased to a minimum, the switching process ends, and the variable-capacity cylinder enters the idling mode.

It can be seen that a transition region from t1 to t3 is added between the working mode and the idling mode of the variable-capacity cylinder assembly. The longer the time duration $T_1$ of the transition region, the smaller the impact on the compressor during mode switching, and the smaller the vibration of the compressor. Through the testing, when $T1 \geq 5$ seconds, the vibration of the compressor can be significantly reduced when switching the mode.

When the variable-capacity assembly is switched from the idling mode to the working mode, the action processes of the first solenoid valve and the second solenoid valve can be as follows.

Figure 8:
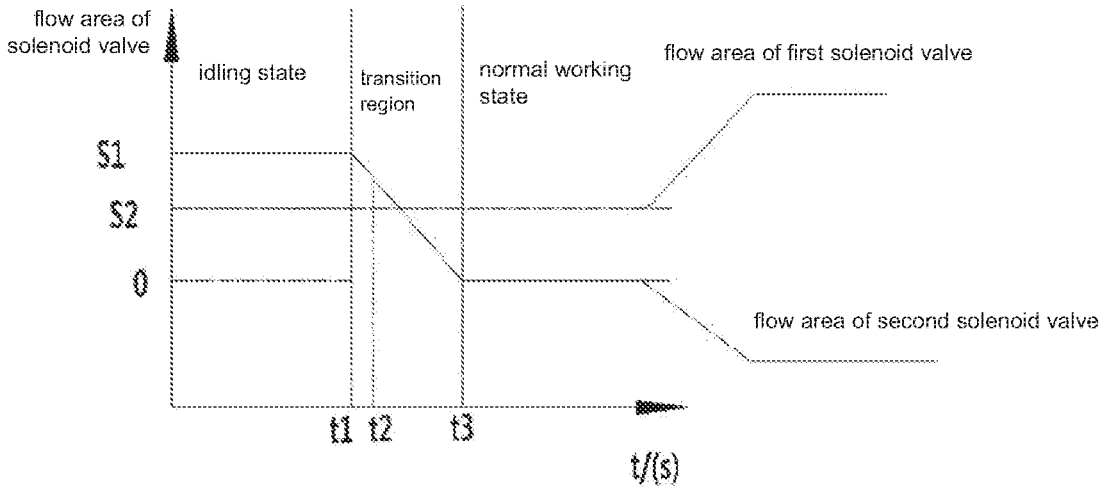
FIG. 8 is a sequence diagram of a solenoid valve flow area when a variable-capacity cylinder is switched from an idling state into a working state according to an embodiment of the present disclosure.

(41) As shown in FIG. 8, when the variable-capacity cylinder is in the idling state (also referred to as the idling mode), the first solenoid valve is in the open or closed state (its flow area can be any value between 0 and $S_1$; and when the flow area is 0, it means the first solenoid valve is in the closed state), the second solenoid valve is in the closed state.

(42) When the variable-capacity cylinder assembly needs to be switched to the working mode at the moment t1, the flow area of the first solenoid valve is adjusted to the maximum value, and then the second solenoid valve is opened (the flow area of the second solenoid valve is S2 at this time); at this time, a part of the high-pressure gas in the housing may enter the dispenser intake port through the high-pressure control pipe and the low-pressure control pipe; and a part of the high-pressure gas in the space between the variable-capacity cylinder intake port and the second solenoid valve may also flow into the dispenser intake port through the low-pressure side intake pipe. Due to the existence of the buffer and the maximum flow area of the first solenoid valve, the pressure at the variable-capacity cylinder intake port is decreased to a certain extent, but the pressure drop is controlled. The flow area of the first solenoid valve is gradually reduced, the high-pressure gas entering the buffer from the inside of the housing is reduced, and the high-pressure gas flowing out of the buffer from the second solenoid valve does not change, such that the pressure from the variable-capacity cylinder intake port to the inside of the buffer is gradually decreased and a differential pressure with the exhaust back pressure is $\Delta P_0$.

Figure 9:
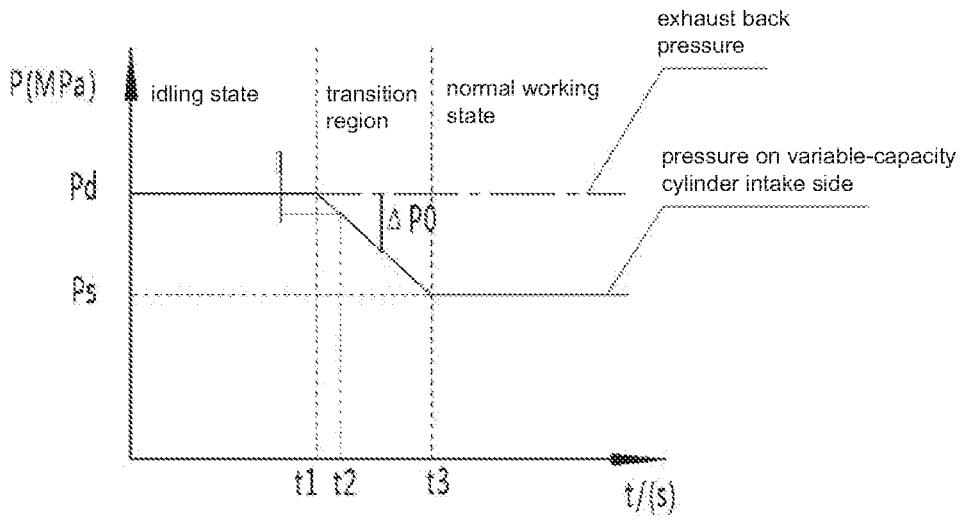
FIG. 9 is a sequence diagram of a pressure on a intake side of a variable-capacity cylinder when the variable-capacity cylinder is switched from an idling state into a working state according to an embodiment of the present disclosure.
Figure 10:
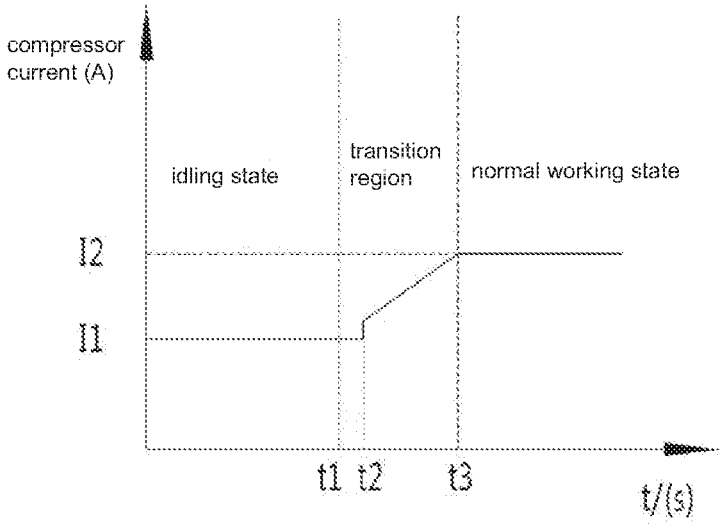
FIG. 10 is a sequence diagram of a compressor current when a variable-capacity cylinder is switched from an idling state into a working state according to an embodiment of the present disclosure.

(43) At the moment t2, when the pressure difference satisfies the condition under which the variable-capacity sliding vane can be free from the restraint of the sliding vane restraint unit (for the embodiment I: $\Delta P_0 \geq \Delta P_a$; for the embodiment II: $\Delta P_0 \geq \Delta P_b$; for the embodiment III: $\Delta P_0 \geq \Delta P_c$, the variable-capacity sliding vane moves toward the roller under the action of the gas force until the variable-capacity sliding vane fits the roller, the variable-capacity cylinder is divided into a space on an intake side and a space on an exhaust side; the gas is compressed and discharged by the driving of the crankshaft. The high-pressure gas is continuously supplemented at the first solenoid valve, but the pressure in the variable-capacity cylinder assembly is not decreased rapidly. After that, the flow area of the first solenoid valve is further reduced and the second solenoid valve is kept open (or the second solenoid valve is closed). The pressure on the intake side of the variable-capacity cylinder and the compressor current are gradually increased (for example, see the example as shown in FIG. 11) until the moment t2, the flow area of the first solenoid valve is 0 (that is, completely closed), the pressure on the intake side of the variable-capacity cylinder is equal to the pressure on the dispenser intake port (for example, see the example as shown in FIG. 9), the check valve is turned on, and the compressor current is increased to the maximum value; then the switching process ends and the variable-capacity cylinder is turned into the working state.

It can be seen that a transition region from t1 to t3 is also added between the idling mode and the working mode of the variable-capacity cylinder assembly (for example, see the example as shown in FIG. 8). The longer the duration $T_1$ of the transition region, the smaller the impact on the compressor during the mode switching, and the smaller the vibration of the compressor. Through the testing, when $T2 \geq 10$ seconds, the vibration of the compressor can be significantly reduced when switching the mode.

In an optional embodiment, the combination of variable frequency and variable capacity can further extend the range of cooling and heat adjustment, and has a broad application prospect.

Since the processing and function implemented by the compressor of the present embodiment substantially correspond to the embodiments, principles, and examples of the variable-capacity control structure shown in FIG. 1 to FIG. 18 described above. Therefore, for details that are not described in the present embodiment, reference may be made to the related descriptions in the foregoing embodiments, and the details are not repeated herein.

After a large number of testing and verifications, by adopting the technical solution of the present disclosure and by controlling the variable-capacity cylinder assembly to act orderly, the probability of vibration and shutdown of the compressor during switching the mode is significantly reduced, thereby avoiding the pipeline break caused by the switching and improving the switching reliability of the compressor.

According to an embodiment of the present disclosure, a variable-capacity control method for a compressor corresponding to the compressor is further provided. The variable-capacity control method for the compressor may include the following steps.

(1) The variable-capacity assembly is caused to act in a setting order.

Therefore, for example, the switching process of the variable-capacity cylinder from the working mode to the idling mode includes:

(i) the second solenoid valve is closed (if the second solenoid valve was in the closed state before, the second solenoid valve continues to maintain the closed state);

(ii) the flow area of the first solenoid valve is gradually increased from 0 to the maximum value $S_1$, with the time duration $T_1$;

(iii) after the switching process is completed, the state of the first solenoid valve can be in a state with a flow area of 0 or a maximum value $S_1$, and the second solenoid valve is continuously closed.

For example, the switching process of the variable-capacity cylinder from idling mode to working mode includes:

(i) the open of the first solenoid valve is controlled to make the flow area be the maximum value $S_1$;

(ii) the second solenoid valve is switched from the closed state to the open state, with the maximum allowed flow area $S_2$;

(iii) the flow area of the first solenoid valve is gradually decreased from the maximum value $S_1$ to 0, with the time duration $T_2$;

(iv) after the completion of the switching, the flow section of the first solenoid valve is 0 (that is, in the completely closed state), and the second solenoid valve continues to maintain in the open state or closed state.

Therefore, through providing the variable-capacity assembly, the actions can be performed in a setting order, which significantly reduces the probability of vibration and shutdown of the compressor during switching the mode, thereby avoiding pipeline break caused by the switching, implementing the reliability of control the switching of the state of the variable-capacity cylinder assembly and improving the reliability of switching of the compressor.

In an optional example, when the variable-capacity assembly may include a check valve 14, a throttling element and an on-off element, the step (1) of causing the variable-capacity cylinder assembly to act in the setting order may include the switching process of the variable-capacity cylinder assembly from the working state to the idling state.

During the switching process of the variable-capacity cylinder assembly from the working state to the idling state:

(11) the on-off element is caused to be in the close state;

(12) the opening degree of the throttling element is gradually increased from the lower limit to the upper limit of the setting flow area in the first transition time;

(13) after the switching process of the variable-capacity cylinder assembly from the working state to the idling state is completed, the opening degree of the throttling element is caused to be any opening degree in a range from the lower limit to the upper limit of the setting flow area, and the on-off element is maintained in the closed state.

More optionally, when the throttling element is in the open state and the on-off element is in the closed state, the check valve 14 is caused to be in the closed state.

For example, the switching process of the variable-capacity cylinder from the working mode to the idling mode includes:

(i) the second solenoid valve is closed (if the second solenoid valve was in the closed state before, the second solenoid valve continues to maintain the closed state);

(ii) the flow area of the first solenoid valve is gradually increased from 0 to the maximum value S 1, with the time duration $T_1$;

(iii) after the switching process is completed, the state of the first solenoid valve can be in a state with a flow area of 0 or a maximum value $S_1$, and the second solenoid valve is continuously caused to be in the closed state.

Optionally, in the step (1) of causing the variable-capacity cylinder assembly to act in the setting order may further include: the switching process of the variable-capacity cylinder assembly from the idling state to the working state.

During the switching process of the variable-capacity cylinder assembly from the idling state to the working state:

(21) the opening degree of the throttling element is caused to be the upper limit of the setting flow area;

(22) the on-off element is caused to be in the open state;

(23) the opening degree of the throttling element is caused to be gradually reduced from the upper limit to the lower limit of the setting flow area in the second transition time;

(24) after the switching process of the variable-capacity cylinder assembly from the idling state to the working state is completed, the opening degree of the throttling element is caused to be at the lower limit of the setting flow area, and the on-off element is maintained in the open state, or the on-off element is caused to be in the closed state.

More optionally, when the throttling element is in the closed state and the on-off element is in the open state, the check valve 14 is caused to be in the on state.

For example, the switching process of the variable-capacity cylinder from idling mode to working mode includes:

(i) the open of the first solenoid valve is controlled to make the flow area be the maximum value $S_1$;

(ii) the second solenoid valve is caused to switch from the closed state to the open state, with the maximum allowed flow area $S_2$;

(iii) the flow area of the first solenoid valve is gradually decreased from the maximum value $S_1$ to 0, with the time duration $T_2$;

(iv) after the completion of the switching, the flow section of the first solenoid valve is 0 (that is, in the completely closed state), and the second solenoid valve continues to maintain in the open state or closed state.

Therefore, the flow area for introducing the high-pressure refrigerant on the high-pressure exhaust side of the compressor into the place between the check valve and the variable-capacity cylinder intake port, is controlled through the throttling element, the control mode is simple and convenient, and the control result has good accuracy and high reliability; on and off of introducing the low-pressure refrigerant on the low-pressure intake side of the compressor into the place between the check valve and the variable-capacity cylinder intake port, is controlled through the on-off element, the control mode is simple and convenient, and the control result has high reliability.

In an optional example, when the variable-capacity cylinder assembly further includes a buffer 16, the step (1) of causing the variable-capacity cylinder assembly to act in the setting order may further include: the speed of reduction of the pressure inside the variable-capacity cylinder 4 in the variable-capacity cylinder assembly during the switching process of the variable-capacity cylinder assembly from the idling state to the working state, is slowed down through the buffer 16.

Therefore, by providing a buffer in the common connection pipe between the variable-capacity cylinder intake port and the check valve, the speed of the pressure decrease inside the variable-capacity cylinder during the switching of the variable-capacity cylinder from the idling state to the working state can be further slowed down, and then the degree of vibration of the compressor during the process of switching the state is further reduced, and the reliability and safety of state switching and operation.

Optionally, the step of slowing down the speed of the pressure decrease inside the variable-capacity cylinder 4 in the variable-capacity cylinder assembly may include:

(31) in the process of gradually reducing the opening degree of the throttling element from the upper limit to the lower limit of the setting flow area, the volume of the high-pressure gas entering the buffer 16 from the housing 1 is reduced, and the volume of the high-pressure gas flowing out of the buffer 16 from the on-off element is not changed; and

(32) the pressure of the gas from the variable-capacity cylinder intake port 10 of the variable-capacity cylinder 4 to the inside of the buffer 16 is gradually reduced; and the pressure difference between the reduced pressure and the exhaust back pressure of the compressor satisfies the condition under which the variable-capacity sliding vane 5 of the variable-capacity cylinder assembly can be free from the restraint of the sliding vane restraint unit.

For example, the existence of a buffer and the flow area of the first solenoid valve is maximum, the pressure at the variable-capacity cylinder intake port is decreased to a certain extent, but the pressure drop is controlled. The flow area of the first solenoid valve is gradually reduced, the high-pressure gas entering the buffer from the inside of the housing is reduced, and the high-pressure gas flowing out of the buffer from the second solenoid valve is not changed, such that the pressure from the variable-capacity cylinder intake port to the inside of the buffer is gradually decreased and the pressure difference with the exhaust back pressure is $\Delta P_0$.

Therefore, by setting the volume of the gas in the buffer, it is possible to more reasonably and more reliably control the degree of reduction of the pressure inside the variable-capacity cylinder.

(2) Under the control of the variable-capacity assembly to act in the setting order, the sliding vane restraint unit 8 causes the variable-capacity cylinder assembly in the compressor to be in the working state or the idling state, thereby implementing the control of the capacity of the compressor.

For example, when the sliding vane in the variable-capacity cylinder (for example, the variable-capacity cylinder 4) contacts the roller, the space in the variable-capacity cylinder is divided into a space on a low-pressure intake side and a space on a high-pressure exhaust side, volumes of which vary with the rotation angle. The crankshaft rotates to compress the gas inhaled into the variable-capacity cylinder, and the variable-capacity cylinder is in the normal working state at this time.

For example, when the sliding vane in the variable-capacity cylinder is returned into the sliding vane groove and is restrained in the sliding vane groove by a sliding vane restraint unit provided in the pump body, the sliding vane is separated from the roller, and only one chamber is left in the variable-capacity cylinder and communicates with the variable-capacity cylinder intake side. When the crankshaft rotates, the gas in the variable-capacity cylinder assembly is no longer compressed, and the variable-capacity cylinder is in the idling state at this time.

The working mode (for example, the working state, the idling state, etc.) of the variable-capacity cylinder assembly is determined by the combined action of the variable-capacity assembly provided outside the housing and the sliding vane restraint unit provided in the pump body.

Therefore, through the cooperative setting of the variable-capacity assembly and the sliding vane restraint unit, the variable-capacity assembly can be controlled to act orderly, thereby significantly reducing the vibration of the compressor during the mode switching, and avoiding the problems such as shutdown and pipeline break occurred during the switching of the compressor.

In an optional example, when the sliding vane restraint unit 8 may include a pin restraint unit, the step (2) of causing the variable-capacity cylinder assembly in the compressor to be in the working state or the idling state may include the switching process of the variable-capacity cylinder assembly from the working state to the idling state.

During the switching process of the variable-capacity cylinder assembly from the working state to the idling state:

(41) the pressure on the variable-capacity cylinder intake side of the variable-capacity cylinder 4 in the variable-capacity cylinder assembly is gradually increased through the variable-capacity assembly until the pin spring 7 at the tail portion of the pin 6 is sufficient to overcome the gas force with a direction opposite to direction of spring force of the pin spring 7, the pressure difference between the head portion and the tail portion of the pin 6 is a first pressure difference.

(42) When the variable-capacity sliding vane 5 of the variable-capacity cylinder assembly is pushed into a set position in the variable-capacity cylinder sliding vane groove of the variable-capacity cylinder assembly under the rotation of the roller of the variable-capacity cylinder assembly, the pin 6 enters the pin groove 26 on the variable-capacity sliding vane 5 to restrain the movement of the variable-capacity sliding vane 5. After that, the variable-capacity sliding vane 5 is disengaged from the roller.

(43) The pressure in the variable-capacity cylinder 4 is caused to continuously increase until the pressure in the variable-capacity cylinder 4 is equal to the high pressure in the housing 1, the switching process ends, and the variable-capacity cylinder assembly is in the idling state.

Optionally, the step (2) of causing the variable-capacity cylinder assembly in the compressor to be in the working state or the idling state may further include a switching process of the variable-capacity cylinder assembly from the idling state to the working state.

During the switching process of the variable-capacity cylinder assembly from the idling state to the working state:

(51) The pressure inside the variable-capacity cylinder 4 in the variable-capacity cylinder assembly is gradually reduced through the variable-capacity assembly until the gas force applied on the pin 6 is sufficient to overcome the spring force of the pin spring 7 and push the pin 6 away from the variable-capacity sliding vane of the variable-capacity cylinder assembly, the pressure difference between the head portion and the tail portion of the pin 6 is the first pressure difference.

(52) The restraint on the variable-capacity sliding vane 5 is released, and meanwhile due to the decrease of the pressure inside the variable-capacity cylinder, the pressure difference between the head portion and the tail portion of the variable-capacity sliding vane 5 is also the first pressure difference.

(53) The variable-capacity sliding vane 5 is driven by the gas force generated by the first pressure difference, to move toward the roller of the variable-capacity cylinder assembly until the variable-capacity sliding vane 5 fits the roller; the variable-capacity cylinder assembly starts to inhale and compress, and the power of the compressor starts to increase accordingly.

(54) Until the pressure in the variable-capacity cylinder 4 is equal to the pressure at the dispenser intake port 15 of the dispenser 11 in the compressor, the check valve 14 in the variable-capacity assembly is turned on, then the switching process ends, and the variable-capacity cylinder assembly is in the working state.

For example, the structure of the pin restraint unit is described in the embodiment I as shown in FIG. 1 to FIG. 3. The sliding vane restraint unit may include: a pin (for example, the pin 6) provided in a vertical direction of the variable-capacity sliding vane (for example, the variable-capacity sliding vane 5) in the variable-capacity cylinder assembly, and a spring (for example, the pin spring 7) provided on the pin tail portion.

One end of the variable-capacity sliding vane in the radial direction of the cylinder is close to the roller (foe example, the roller 20), which is referred to as a sliding vane head portion, such as the sliding vane head portion 24; and the other end is away from the roller, which is referred to as a sliding vane tail portion, such as the sliding vane tail portion 25. The variable-capacity sliding vane is restrained by the bearings on both sides in the axial direction of the cylinder, and is provided with a pin groove (for example, the pin groove 26) on the side near the pin.

Specifically, the pin is provided in a bearing adjacent to the variable-capacity cylinder, one end of the pin is close to the variable-capacity sliding vane (referred to as a pin head portion), and the other end of the pin is far from the variable-capacity sliding vane (referred to as a pin tail portion). The sliding vane tail portion and the pin head portion communicate with the high pressure inside the housing. The pressure on the sliding vane head portion is the same as the pressure in the variable-capacity cylinder. The pin tail portion communicates with the variable-capacity cylinder intake port through the pin communication channel (for example, the pin communication channel 9) inside the pump body.

In a more optional specific example, the switching process of the variable-capacity cylinder assembly from the normal working mode to the idling mode may include:

when the pressure in the variable-capacity cylinder is at a low pressure and the pressure is equal to the pressure at the dispenser intake port, the variable-capacity cylinder assembly is in the normal working state. The pressure on the intake side of the variable-capacity cylinder is gradually increased through the variable-capacity assembly until the spring force at the pin tail portion is sufficient to overcome the gas force with a direction opposite to the direction of the spring force (at this time, the pressure difference between the head portion and the tail portion of the pin is ΔPa); When the variable-capacity sliding vane is pushed into the variable-capacity cylinder sliding vane groove to a certain position under the rotation of the roller, the pin enters the pin groove on the variable-capacity sliding vane to restrain the movement of the variable-capacity sliding vane. After that, the variable-capacity sliding vane is disengaged from the roller, and the pressure in the variable-capacity cylinder continues to increase until the pressure is equal to the high pressure in the housing, then the switching process ends, and the variable-capacity cylinder assembly enters the idling mode.

In a more optional specific example, the switching process of the variable-capacity cylinder assembly from the idling mode to the normal working mode may include:

when the pressure in the variable-capacity cylinder is at a high pressure and the pressure is equal to the pressure in the housing, the variable-capacity cylinder assembly is in the idling state. The pressure in the variable-capacity cylinder is gradually decreased through the variable-capacity assembly until the applied gas force is sufficient to overcome the spring force and push the pin away from the variable-capacity sliding vane (the pressure difference between the head portion and the tail portion of the pin at this time is ΔPa), the restraint applied on the variable-capacity sliding vane is released. At the same time, since the pressure in the variable-capacity cylinder is decreased and the pressure difference between the head portion and the tail portion of the sliding vane is also ΔPa, the resulting gas force pushes the variable-capacity sliding vane to move toward the roller until the variable-capacity sliding vane fits the roller. At this time, the variable-capacity cylinder assembly starts to inhale and compress, and the compressor power starts to increase accordingly until the pressure in the variable-capacity cylinder is equal to the pressure at the dispenser intake port, the check valve is turned on and the switching process ends, then the variable-capacity cylinder assembly enters the normal working mode.

Therefore, it is convenient to mount the pint by providing a pin groove, and it is also convenient for the pin and the pin spring to control the variable-capacity sliding vane. The mounting is firm and the reliability of the control is high.

In an optional example, when the sliding vane restraint unit 8 may include a magnetic element restraint unit, the step (2) of causing the variable-capacity cylinder assembly in the compressor to be in the working state or idling state may include the switching process of the variable-capacity cylinder assembly from the working state to the idling state.

During the switching process of the variable-capacity cylinder assembly from the working state to the idling state:

(61) the pressure inside the variable-capacity cylinder 4 in the variable-capacity cylinder assembly is gradually increased through the variable-capacity assembly, to close the check valve 14 in the variable-capacity assembly until the pressure inside the variable-capacity cylinder 4 is increased to an extent such that the magnetic element 22 is sufficient to overcome the gas force generated by the variable-capacity sliding vane 5 of the variable-capacity cylinder assembly due to a pressure difference, the pressure difference between the head portion and the tail portion of the variable-capacity sliding vane 5 is the second pressure difference.

(62) The variable-capacity sliding vane 5 is pushed into the variable-capacity cylinder sliding vane groove of the variable-capacity cylinder assembly by a rotating roller in the variable-capacity cylinder assembly, and is restrained in the variable-capacity cylinder sliding vane groove due to the magnetic force generated by the magnetic element 22 on the variable-capacity sliding vane 5. After that, the pressure inside the variable-capacity cylinder 4 continues to increase to be equal to the pressure inside the housing 1, then the switching process ends and the variable-capacity cylinder assembly is in the idling state.

Optionally, the step (2) of causing the variable-capacity cylinder assembly in the compressor to be in the working state or the idling state may further include a switching process of the variable-capacity cylinder assembly from the idling state to the working state.

During the switching process of the variable-capacity cylinder assembly from the idling state to the working state:

(71) The pressure inside the variable-capacity cylinder 4 in the variable-capacity cylinder assembly is gradually decreased through the variable-capacity assembly until the pressure in the variable-capacity cylinder 4 is decreased to an extent such that the gas force generated by the variable-capacity sliding vane 5 in the variable-capacity cylinder assembly due to the pressure difference between the head portion and the tail portion of the variable-capacity sliding vane 5 is sufficient to overcome the magnetic force applied by the magnetic element on the variable-capacity sliding vane, the pressure difference between the head portion and the tail portion of the variable-capacity sliding vane 5 is the second pressure difference.

(72) The variable-capacity sliding vane 5 is caused to be free from the restraint of the magnetic element 22, and the variable-capacity sliding vane 5 is caused to move toward the roller of the compressor under the action of the gas force until the variable-capacity sliding vane 5 fits the roller, such that the space in the variable-capacity assembly is divided into a space on an intake side and a space on an exhaust side.

(73) The pressure on the variable-capacity cylinder intake side of the variable-capacity cylinder 4 continues to decrease to cause the power of the compressor to gradually increase until the pressure on the variable-capacity cylinder intake side is equal to the pressure at the dispenser intake port 15 of the dispenser 11 in the compressor, the check valve 14 in the variable-capacity assembly is caused to turn on, then the switching process ends, and the variable-capacity cylinder assembly is in the working state.

For example, the magnetic element restraint unit is described in the embodiment II as shown in FIGS. 4 and 5. The sliding vane restraint unit may mainly consist of a magnetic element (for example, the magnetic element 22) provided at the tail portion of the variable-capacity sliding vane.

The magnetic element is fixed at the tail portion of the variable-capacity cylinder sliding vane groove, and has a magnetic force that attracts the variable-capacity sliding vane and makes the variable-capacity sliding vane have a tendency moving toward the magnetic element.

In a more optional specific example, the switching process of the variable-capacity cylinder assembly from the normal working mode to the idling mode may include:

when the pressure in the variable-capacity cylinder is at a low pressure and is equal to the pressure at the dispenser intake port, the variable-capacity cylinder assembly is in the normal working state. The pressure inside the variable-capacity cylinder in the variable-capacity assembly is gradually increased, the check valve is closed until the pressure inside the variable-capacity cylinder is increased to an extent such that the magnetic element is sufficient to overcome the gas force generated by the variable-capacity sliding vane due to the pressure difference (at this time the pressure difference between the head portion and the tail portion of the variable-capacity sliding vane is $\Delta Pb$), the variable-capacity sliding vane is pushed into the variable-capacity cylinder sliding vane groove by the rotating roller, and is restrained in the sliding vane groove by the magnetic force generated by the magnetic element on the variable-capacity sliding vane; after that, the pressure continues to increase to be equal to the pressure inside the housing, then the switching process ends, and the variable-capacity cylinder assembly enters the idling mode.

In a more optional specific example, the switching process of the variable-capacity cylinder assembly from the idling mode to the normal working mode may include:

when the pressure inside the variable-capacity cylinder is at a high pressure and is equal to the pressure inside the housing, the variable-capacity cylinder assembly is in the idling state. The pressure in the variable-capacity cylinder is gradually decreased through the variable-capacity assembly until the pressure inside the variable-capacity cylinder is decreased to an extent such that the gas force generated by the variable-capacity sliding vane due to the pressure difference between the head portion and the tail portion of the variable-capacity sliding vane is sufficient to overcome the magnetic force applied by the magnetic element on the variable-capacity sliding vane (at this time, the pressure difference between the head portion and the tail portion of the variable-capacity sliding vane is $\Delta Pb$), the variable-capacity sliding vane is free from the restraint of the magnetic element and moves toward the roller under the action of the gas force until the variable-capacity sliding vane fits the roller; the space inside the variable-assembly is divided into a space on an intake side and a space on an exhaust side. The pressure on the variable-capacity cylinder intake side continues to decrease to cause the compressor power to gradually increase until the pressure on the intake side of the variable-capacity cylinder is equal to the pressure at the dispenser intake port, the check valve is turned on, then the switching process ends and the variable-capacity cylinder assembly enters the normal working mode.

Therefore, the variable-capacity sliding vane is restrained through the magnetic element, the structure is simple and the control mode is simple.

In an optional example, when the sliding vane restraint unit 8 may include a sliding vane restraint hole restraint unit, the step (2) of causing the variable-capacity cylinder assembly in the compressor to be in the working state or the idling state may include: the switching process of the variable-capacity cylinder assembly from the working state to the idling state.

During the switching process of the variable-capacity cylinder assembly from the working state to the idling state:

(81) The pressure on the variable-capacity cylinder intake side of the variable-capacity cylinder 4 in the variable-capacity cylinder assembly is gradually increased through the variable-capacity assembly until the frictional force generated by the sliding vane restraint hole 23 on the variable-capacity sliding vane 5 in the variable-capacity cylinder assembly is sufficient to overcome the gas force generated by the variable-capacity sliding vane 5 due to the pressure difference, the pressure difference between the head portion and the tail portion of the variable-capacity sliding vane 5 is a third pressure difference.

(82) The variable-capacity sliding vane 5 is pushed into the variable-capacity cylinder sliding vane groove in the variable-capacity cylinder assembly, and is restrained in the variable-capacity cylinder sliding vane groove through the frictional force. After that, the pressure on the variable-capacity cylinder intake side of the variable-capacity cylinder 4 continues to increase to be equal to the pressure in the housing 1, then the switching process ends, and the variable-capacity cylinder assembly is in the idling state.

Optionally, the step (2) of causing the variable-capacity cylinder assembly in the compressor to be in the working state or the idling state may further include a switching process of the variable-capacity cylinder assembly from the idling state to the working state.

During the switching process of the variable-capacity cylinder assembly from the idling state to the working state:

(91) The pressure inside the variable-capacity cylinder 4 in the variable-capacity cylinder assembly is gradually decreased through the variable-capacity assembly until the pressure in the variable-capacity cylinder 4 is increased to an extent such that the gas force generated by the variable-capacity sliding vane 5 in the variable-capacity cylinder assembly due to the pressure difference between the head portion and the tail portion of the variable-capacity sliding vane 5 is sufficient to overcome the frictional force on the variable-capacity sliding vane 5 generated by the high pressure introduced by the sliding vane restraint hole 23, the pressure difference between the head portion and the tail portion of the variable-capacity sliding vane is third pressure difference.

(92) The variable-capacity sliding vane 5 is caused to be free from restraint of the frictional force, and move toward the roller in the compressor under the action of the gas force generated by the pressure difference between the head portion and the tail portion of the variable-capacity sliding vane 5 until the variable-capacity sliding vane 5 fits the roller, the space in the variable-capacity assembly is divided into a space on an intake side and a space on an exhaust side.

(93) The pressure on the variable-capacity cylinder intake side of the variable-capacity cylinder 4 continues to decrease to cause the power of the compressor to gradually increase until the pressure on the variable-capacity cylinder intake side is equal to the pressure at the dispenser intake port 15 of the dispenser 11 in the compressor, the check valve 14 in the variable-capacity assembly is turned on, then the switching process ends, and the variable-capacity cylinder assembly is in the working state.

For example, the structure of the sliding vane restraint hole restraint unit is described in the embodiment III as shown in FIG. 6 and FIG. 7. In a direction at a certain angle to the moving direction of the variable-capacity sliding vane, a sliding vane restraint hole (for example, the sliding vane restraint hole 23) is provided on a side of the variable-capacity cylinder away from the intake port side; and the high pressure in the housing is introduced to the variable-capacity sliding vane groove side and is in communication with the variable-capacity sliding vane groove.

The pressure generated by the introduced high pressure acts on the variable-capacity sliding vane to make the variable-capacity sliding vane tightly fit the other side of the variable-capacity sliding vane groove, and the direction of the pressure is perpendicular to the linear movement direction of the variable-capacity sliding vane, which makes a frictional force generated between the variable-capacity sliding vane and the tightly fitted side of the variable-capacity cylinder sliding vane groove, and the frictional force has a tendency preventing the movement of the variable-capacity sliding vane.

In a more optional specific example, the switching process of the variable-capacity cylinder assembly from the normal working mode to the idling mode may include:

when the pressure in the variable-capacity cylinder is at a low pressure and is equal to the pressure at the dispenser intake port, the variable-capacity cylinder assembly is in the normal working state. The pressure on the variable-capacity cylinder intake side is gradually increased through the variable-capacity assembly until the frictional force generated by the sliding vane restraint hole on the variable-capacity sliding vane is sufficient to overcome the gas force generated by the variable-capacity sliding vane due to the pressure difference (at this time the pressure difference between the head portion and the tail portion of the variable-capacity sliding vane is $\Delta P_c$), the variable-capacity sliding vane is pushed into the variable-capacity cylinder sliding vane groove and is restrained in the variable-capacity cylinder sliding vane groove by the frictional force; after that, the pressure continues to increase to be equal to the pressure in the housing, then the switching process ends, and the variable-capacity cylinder assembly enters the idling state.

In a more optional specific example, the switching process of the variable-capacity cylinder assembly from the idling mode to the normal working mode may include:

when the pressure in the variable-capacity cylinder is at a high pressure and is equal to the pressure in the housing, the variable-capacity cylinder assembly is in the idling state. The pressure in the variable-capacity cylinder is gradually decreased through the variable-capacity assembly until the pressure in the variable-capacity cylinder is decreased to an extent such that the gas force generated by the variable-capacity sliding vane due to the pressure difference between the head portion and the tail portion of the variable-capacity sliding vane is sufficient to overcome the frictional force on the sliding vane generated by the high pressure introduced by the sliding vane restraint hole (at this time, the pressure difference between the head portion and the tail portion of the variable-capacity sliding vane is $\Delta Pb$), the variable-capacity sliding vane is free from the restraint of the frictional force and moves toward the roller under the action of the gas force until the variable-capacity sliding vane fits the roller; the space in the variable-capacity assembly is divided into a space on an intake side and a space on an exhaust side. The pressure on the variable-capacity cylinder intake side continues to decrease to cause the compressor power to gradually increase, until the pressure on the variable-capacity cylinder intake side is equal to the pressure at the dispenser intake port, the check valve is turned on, then the switching process ends and the variable-capacity cylinder assembly enters the normal working mode.

Therefore, the frictional force, formed under the action of the pressure introduced by the variable-capacity sliding vane through the sliding vane restraint hole, is utilized to perform the restraint, the structure is simpler, the control mode is simpler and more convenient, and the reliability can be guaranteed.

Since the processing and functions implemented by the variable-capacity control method for the compressor in the present embodiment substantially correspond to the foregoing embodiments, principles, and examples of the compressor. For details that are not described in the present embodiment, reference may be made to the related descriptions in the foregoing embodiments, and the details are not repeated herein.

After a large number of testing and verifications, through the technical solution of the present disclosure, by causing the variable-capacity assembly to act orderly and combing the sliding vane restraint unit, the variable-capacity cylinder assembly is caused to be in a working or idling state, thereby significantly reducing the violent vibration during the state switching and improving the reliability of state switching and operation of the compressor.

In conclusion, it is easy for those skilled in the art to understand that the above-mentioned advantageous modes can be freely combined and superimposed under the premise of no conflict.

The above embodiments are merely some embodiments of the present disclosure and are not intended to limit the present disclosure. For those skilled in the art, the present disclosure may have various modifications and variations. Any modification, equivalent replacement, improvement and so on made within the spirit and principle of the present disclosure shall be included in the scope of the protection of the claims of the present disclosure.

What is claimed is:

1. A variable-capacity control structure, comprising: a variable-capacity assembly and a sliding vane restraint unit; wherein the variable-capacity assembly is provided outside a housing of a compressor to which the variable-capacity control structure is attached, and is configured to act in a setting order;

the sliding vane restraint unit is provided inside a pump body of the compressor, and is configured to cause a variable-capacity cylinder assembly in the compressor to be in a working state or an idling state under controlling the variable-capacity assembly to act in the setting order;

wherein the variable-capacity assembly comprises a check valve;

wherein the check valve is provided in a pipeline between a variable-capacity cylinder intake port of a variable-capacity cylinder in the variable-capacity cylinder assembly and a second dispenser outlet of a dispenser in the compressor, and is configured to be in an on state when a refrigerant flows from the second dispenser outlet to the variable-capacity cylinder intake port, or be in a cut-off state when the refrigerant flows from the variable-capacity cylinder intake port to the second dispenser outlet;

wherein the variable-capacity assembly further comprises a throttling element and an on-off element;

wherein the throttling element is provided in a pipeline in which a high-pressure side control pipe is located, the high-pressure side control pipe being drawn from a high-pressure exhaust side inside the housing, and the throttling element is configured to introduce a high-pressure refrigerant on the high-pressure exhaust side into a place between the check valve and the variable-capacity cylinder intake port according to a setting flow area when both the check valve and the on-off element are in a closed state while the throttling element is in an open state; and wherein the on-off element is provided in a pipeline in which a low-pressure side control pipe is located, the low-pressure side control pipe being drawn from a low-pressure intake side inside the dispenser, and the on-off element is configured to introduce a low-pressure refrigerant on the low-pressure intake side into a place between the check valve and the variable-capacity cylinder intake port when the check valve and the on-off element are both in the open state while the throttling element is in the closed state.

2. The structure according to claim 1, wherein, in the variable-capacity assembly, a common connection pipe is drawn between the variable-capacity cylinder intake port and the check valve, both the other end of the high-pressure side control pipe and the other end of the low-pressure side control pipe are connected to the common connection pipe;

the variable-capacity assembly further comprises: a buffer;

the buffer is provided in a pipeline in which the common connection pipe drawn between the variable-capacity cylinder intake port and the check valve is located, and the buffer is configured to slow down a speed of decrease of a pressure in the variable-capacity cylinder when the variable-capacity cylinder is switched from the idling state to the working state.

3. The structure according to claim 2, wherein, the throttling element comprises at least one of a first solenoid valve, an electronic expansion valve and a capillary tube;

an upper limit of the setting flow area is adjusted by the throttling element to be greater than or equal to: a first setting coefficient times a product of an allowable maximum operating frequency of the variable-capacity cylinder assembly when switching between states and a working volume of the variable-capacity cylinder in the working state; wherein the switching between the states comprises: switching from the working state to the idling state, or switching from the idling state to the working state;

when the variable-capacity cylinder assembly is switched from the working state to the idling state, a time during which an opening degree of the throttling element is reduced from the upper limit to a lower limit of the setting flow area is a first transition time;

when the variable-capacity cylinder assembly is switched from the idling state to the working state, a time during which the opening degree of the throttling element is increased from the lower limit to the upper limit of the setting flow area is a second transition time; wherein the first transition time is greater than or equal to a first setting time, the second transition time is greater than or equal to a second setting time, and the second setting time is greater than the first setting time;

the on-off element comprises: at least one of a second solenoid valve, an electric switch and a manual switch;

an allowable flow area when the on-off element is turned on is less than or equal to a second setting coefficient times the working volume of the variable-capacity cylinder in the working state;

when the variable-capacity assembly further comprises the buffer, a volume of a gas that the buffer holds is greater than or equal to a third setting coefficient times the working volume of the variable-capacity cylinder in the working state.

4. The structure according to claim 2, wherein, the sliding vane restraint unit comprises any one of a pin restraint unit, a magnetic element restraint unit and a sliding vane restraint hole restraint unit; wherein the pin restraint unit comprises: a pin and a pin spring; wherein the pin is provided in a vertical direction of a variable-capacity sliding vane in the variable-capacity cylinder assembly, and is located in a bearing in the compressor, the bearing being adjacent to the variable-capacity cylinder in the variable-capacity cylinder assembly;

the pin spring is provided at a tail portion of the pin;

the magnetic element restraint unit comprises a magnetic element;

the magnetic element is provided at a tail portion of the variable-capacity sliding vane in the variable-capacity cylinder assembly, and is configured to attract the variable-capacity sliding vane to make the variable-capacity sliding vane move toward the magnetic element;

the sliding vane restraint hole restraint unit comprises a sliding vane restraint hole;

the sliding vane restraint hole is located in a direction at a setting angle to a moving direction of the variable-capacity sliding vane in the variable-capacity cylinder assembly, and is provided on a side of the variable-capacity cylinder in the variable-capacity cylinder assembly, the side being opposite to the variable-capacity cylinder intake port of the variable-capacity cylinder, the sliding vane restraint hole is configured to introduce a high-pressure gas in the housing to a side of a variable-capacity sliding vane groove of the variable-capacity sliding vane and is in communication with the variable-capacity sliding vane groove.

5. The structure according to claim 1, wherein, the throttling element comprises a first solenoid valve;

an upper limit of the setting flow area is adjusted by the throttling element to be greater than or equal to: a first setting coefficient times a product of an allowable maximum operating frequency of the variable-capacity cylinder assembly when switching between states and a working volume of the variable-capacity cylinder in the working state; wherein the switching between the states comprises: switching from the working state to the idling state, or switching from the idling state to the working state;

when the variable-capacity cylinder assembly is switched from the working state to the idling state, a time during which an opening degree of the throttling element is reduced from the upper limit to a lower limit of the setting flow area is a first transition time;

when the variable-capacity cylinder assembly is switched from the idling state to the working state, a time during which the opening degree of the throttling element is increased from the lower limit to the upper limit of the setting flow area is a second transition time; wherein the first transition time is greater than or equal to a first setting time, the second transition time is greater than or equal to a second setting time, and the second setting time is greater than the first setting time;

the on-off element comprises: at least one of a second solenoid valve, an electric switch and a manual switch;

an allowable flow area when the on-off element is turned on is less than or equal to a second setting coefficient times the working volume of the variable-capacity cylinder in the working state;

when the variable-capacity assembly further comprises the buffer, a volume of a gas that the buffer holds is greater than or equal to a third setting coefficient times the working volume of the variable-capacity cylinder in the working state.

6. The structure according to claim 1, wherein, the sliding vane restraint unit comprises any one of a pin restraint unit, a magnetic element restraint unit and a sliding vane restraint hole restraint unit; wherein the pin restraint unit comprises: a pin and a pin spring; wherein the pin is provided in a vertical direction of a variable-capacity sliding vane in the variable-capacity cylinder assembly, and is located in a bearing in the compressor, the bearing being adjacent to the variable-capacity cylinder in the variable-capacity cylinder assembly;

the pin spring is provided at a tail portion of the pin;

the magnetic element restraint unit comprises a magnetic element;

the magnetic element is provided at a tail portion of the variable-capacity sliding vane in the variable-capacity cylinder assembly, and is configured to attract the variable-capacity sliding vane to make the variable-capacity sliding vane move toward the magnetic element;

the sliding vane restraint hole restraint unit comprises a sliding vane restraint hole;

the sliding vane restraint hole is located in a direction at a setting angle to a moving direction of the variable-capacity sliding vane in the variable-capacity cylinder assembly, and is provided on a side of the variable-capacity cylinder in the variable-capacity cylinder assembly, the side being opposite to the variable-capacity cylinder intake port of the variable-capacity cylinder, the sliding vane restraint hole is configured to introduce a high-pressure gas in the housing to a side of a variable-capacity sliding vane groove of the variable-capacity sliding vane and is in communication with the variable-capacity sliding vane groove.

7. The structure according to claim 6, wherein, the pin restraint unit further comprises: a pin groove; the pin groove is provided at a tail portion of the variable-capacity sliding vane in a vertical direction; the pin is provided in the pin groove;

in the pin restraint unit, both the tail portion and a head portion of the variable-capacity sliding vane are in communication with the high-pressure gas in the housing;

a pressure on the head portion of the variable-capacity sliding vane is the same as a pressure inside the variable-capacity cylinder;

the tail portion of the pin communicates with the variable-capacity cylinder intake port of the variable-capacity cylinder through a pin communication channel inside the pump body in the compressor;

in the sliding vane restraint hole restraint unit, the high pressure gas in the housing is introduced by the sliding vane restraint hole to a side of the variable-capacity sliding vane groove of the variable-capacity sliding vane to form a pressure acting on the variable-capacity sliding vane, such that the variable-capacity sliding vane tightly fits the other side of the variable-capacity sliding vane groove;

a direction of the pressure is perpendicular to a direction of a linear movement of the variable-capacity sliding vane, to make a frictional force generated between the variable-capacity sliding vane and a tightly fitted side of the variable-capacity sliding vane groove, to prevent the variable-capacity sliding vane from moving.

8. A compressor, comprising: at least one compression cylinder assembly operating constantly;

further comprising: at least one variable-capacity cylinder assembly which is selectively in a working state or an idling state; wherein the variable-capacity cylinder assembly comprises the variable-capacity control structure according to claim 1.

9. The structure according to claim 1, wherein, the sliding vane restraint unit comprises any one of a pin restraint unit, a magnetic element restraint unit and a sliding vane restraint hole restraint unit; wherein the pin restraint unit comprises: a pin and a pin spring; wherein the pin is provided in a vertical direction of a variable-capacity sliding vane in the variable-capacity cylinder assembly, and is located in a bearing in the compressor, the bearing being adjacent to the variable-capacity cylinder in the variable-capacity cylinder assembly;

the pin spring is provided at a tail portion of the pin;

the magnetic element restraint unit comprises a magnetic element;

the magnetic element is provided at a tail portion of the variable-capacity sliding vane in the variable-capacity cylinder assembly, and is configured to attract the variable-capacity sliding vane to make the variable-capacity sliding vane move toward the magnetic element;

the sliding vane restraint hole restraint unit comprises a sliding vane restraint hole;

the sliding vane restraint hole is located in a direction at a setting angle to a moving direction of the variable-capacity sliding vane in the variable-capacity cylinder assembly, and is provided on a side of the variable-capacity cylinder in the variable-capacity cylinder assembly, the side being opposite to the variable-capacity cylinder intake port of the variable-capacity cylinder, the sliding vane restraint hole is configured to introduce a high-pressure gas in the housing to a side of a variable-capacity sliding vane groove of the variable-capacity sliding vane and is in communication with the variable-capacity sliding vane groove.

10. The structure according to claim 1, wherein, the sliding vane restraint unit comprises any one of a pin restraint unit, a magnetic element restraint unit and a sliding vane restraint hole restraint unit; wherein the pin restraint unit comprises: a pin and a pin spring; wherein the pin is provided in a vertical direction of a variable-capacity sliding vane in the variable-capacity cylinder assembly, and is located in a bearing in the compressor, the bearing being adjacent to the variable-capacity cylinder in the variable-capacity cylinder assembly;

the pin spring is provided at a tail portion of the pin;

the magnetic element restraint unit comprises a magnetic element;

the magnetic element is provided at a tail portion of the variable-capacity sliding vane in the variable-capacity cylinder assembly, and is configured to attract the variable-capacity sliding vane to make the variable-capacity sliding vane move toward the magnetic element;

the sliding vane restraint hole restraint unit comprises a sliding vane restraint hole;

the sliding vane restraint hole is located in a direction at a setting angle to a moving direction of the variable-capacity sliding vane in the variable-capacity cylinder assembly, and is provided on a side of the variable-capacity cylinder in the variable-capacity cylinder assembly, the side being opposite to the variable-capacity cylinder intake port of the variable-capacity cylinder, the sliding vane restraint hole is configured to introduce a high-pressure gas in the housing to a side of a variable-capacity sliding vane groove of the variable-capacity sliding vane and is in communication with the variable-capacity sliding vane groove.

11. A variable-capacity control method performed by a compressor;

wherein the compressor comprises at least one compression cylinder assembly operating constantly, at least one variable-capacity cylinder assembly which is selectively in a working state or an idling state, and a variable-capacity control structure;

wherein the variable-capacity control structure comprises a variable-capacity assembly and a sliding vane restraint unit;

wherein the variable-capacity assembly is provided outside a housing of the compressor to which the variable-capacity control structure is attached and is configured to act in a setting order;

wherein the sliding vane restraint unit is provided inside a pump body of the compressor and is configured to cause a variable-capacity cylinder assembly in the compressor to be in a working state or an idling state under controlling the variable-capacity assembly to act in the setting order; and wherein the method comprises:

causing the variable-capacity assembly to act in a setting order;

causing, by a sliding vane restraint unit, a variable-capacity cylinder assembly in the compressor to be in a working state or an idling state under controlling the variable-capacity assembly to act in the setting order;

wherein, when the variable-capacity assembly comprises a check valve, a throttling element and an on-off element, the causing the variable-capacity assembly to act in the setting order comprises:

during a switching process of the variable-capacity cylinder assembly from the working state to the idling state, causing the on-off element to be in a closed state;

causing an opening degree of the throttling element to gradually increase from a lower limit to an upper limit of a setting flow area within a first transition time;

after completing the switching process of the variable-capacity cylinder assembly from the working state to the idling state, causing the opening degree of the throttling element to be any opening degree in a range from the lower limit to the upper limit of the setting flow area, and maintaining the on-off element in a closed state;

or, during the switching process of the variable-capacity cylinder assembly from the idling state to the working state:

causing the opening degree of the throttling element to be at the upper limit of the setting flow area;

causing the on-off element to be in an open state;

causing the opening degree of the throttling element to be gradually reduced from the upper limit to the lower limit of the setting flow area within a second transition time;

after completing the switching process of the variable-capacity cylinder assembly from the idling state to the working state, causing the opening degree of the throttling element to be at the lower limit of the setting flow area, and maintaining the on-off element in the open state, or causing the on-off element to be in the closed state;

wherein, when the throttling element is in the closed state and the on-off element is in the open state, causing the check valve to be in an on state; or, when the throttling element is in the open state and the on-off element is in the closed state, causing the check valve to be in the closed state.

12. The method according to claim 11, wherein, when the variable-capacity assembly further comprises a buffer, the causing the variable-capacity assembly to act in the setting order further comprises:

during the switching process of the variable-capacity cylinder assembly from the idling state to the working state, slowing down a speed of decrease of a pressure in the variable-capacity cylinder in the variable-capacity cylinder assembly through the buffer.

13. The method according to claim 12, wherein, the slowing down the speed of the decrease of the pressure in the variable-capacity cylinder in the variable-capacity cylinder assembly comprises:

in a process of reducing the opening degree of the throttling element from the upper limit to the lower limit of the setting flow area, causing a volume of a high-pressure gas entering the buffer from the inside of the housing to reduce, and causing a volume of a high-pressure gas flowing out of the buffer from the on-off element not to change; and causing a pressure of a gas from the variable-capacity cylinder intake port of the variable-capacity cylinder to an inside of the buffer to gradually decrease, and causing a pressure difference between the decreased pressure and an exhaust back pressure of the compressor to meet a condition under which the variable-capacity sliding vane of the variable-capacity cylinder assembly is free from a constraint of the sliding vane restraint unit.

14. The method according to claim 11, wherein, when the sliding vane restraint unit comprises a pin restraint unit, the causing variable-capacity cylinder assembly in the compressor to be in the working state or the idling state comprises:

during the switching process of the variable-capacity cylinder assembly from the working state to the idling state:

gradually increasing a pressure on a variable-capacity cylinder intake side of the variable-capacity cylinder in the variable-capacity cylinder assembly through the variable-capacity assembly, until a pin spring at a tail portion of a pin is sufficient to overcome a gas force with a direction opposite to a direction of a spring force of the pin spring, a pressure difference between a head portion and a tail portion of the pin being a first pressure difference;

when the variable-capacity sliding vane of the variable-capacity cylinder assembly is pushed into a setting position in a variable-capacity cylinder sliding vane groove of the variable-capacity cylinder assembly under a rotation of a roller of the variable-capacity cylinder assembly, the pin enters a pin groove of the compressor on the variable-capacity sliding vane to restrain a movement of the variable-capacity sliding vane; after that, the variable-capacity sliding vane is disengaged from the roller;

causing a pressure in the variable-capacity cylinder to continue to increase until the pressure in the variable-capacity cylinder is equal to a high pressure in the housing, then the switching process ends, and the variable-capacity cylinder assembly is in the idling state; or, during the switching process of the variable-capacity cylinder assembly from the idling state to the working state:

gradually decreasing the pressure in the variable-capacity cylinder in the variable-capacity cylinder assembly through the variable-capacity assembly, until the gas force applied on the pin is sufficient to overcome the spring force of the pin spring and pushes the pin away from the variable-capacity sliding vane of the variable-capacity cylinder assembly, a pressure difference between the head portion and the tail portion of the pin being also the first pressure difference;

releasing the restraint applied on the variable-capacity sliding vane, meanwhile due to the pressure in the variable-capacity cylinder is decreased, a pressure difference between a head portion and a tail portion of the variable-capacity sliding vane being the first pressure difference;

driving, by a gas force generated by the first pressure difference, the variable-capacity sliding vane to moves toward the roller of the variable-capacity cylinder assembly until the variable-capacity sliding vane fits the roller, the variable-capacity cylinder assembly starts to inhale and compress, and a power of the compressor starts to increase accordingly;

until the pressure in the variable-capacity cylinder is equal to a pressure at a dispenser intake port of a dispenser in the compressor, the check valve in the variable-capacity assembly is turned on, then the switching process ends, and the variable-capacity cylinder assembly is in the working state; or, when the sliding vane restraint unit comprises a magnetic element restraint unit which comprises a magnetic element, the causing the variable-capacity cylinder assembly in the compressor to be in the working state or in the idling state comprises:

during the switching process of the variable-capacity cylinder assembly from the working state to the idling state:

gradually increasing the pressure inside the variable-capacity cylinder in the variable-capacity cylinder assembly through the variable-capacity assembly, to close the check valve in the variable-capacity assembly until the pressure inside the variable-capacity cylinder is increased to an extent such that the magnetic element is sufficient to overcome the gas force generated by the variable-capacity sliding vane of the variable-capacity cylinder assembly due to a pressure difference between a head portion and a tail portion of the variable-capacity sliding vane, the pressure difference between the head portion and the tail portion of the variable-capacity sliding vane being a second pressure difference;

pushing the variable-capacity sliding vane into the variable-capacity sliding vane groove of the variable-capacity cylinder assembly by a rotating roller in the variable-capacity cylinder assembly, and restraining the variable-capacity sliding vane in the variable-capacity cylinder sliding vane groove due to a magnetic force generated by the magnetic element on the variable-capacity sliding vane; after that, continuously increasing the pressure inside the variable-capacity cylinder to be equal to the pressure inside the housing, then ending the switching process and the variable-capacity cylinder assembly being in the idling state;

or, during the switching process of the variable-capacity cylinder assembly from the idling state to the working state:

gradually decreasing the pressure inside the variable-capacity cylinder in the variable-capacity cylinder assembly through the variable-capacity assembly, until the pressure inside the variable-capacity cylinder is decreased to an extent such that the gas force generated by the variable-capacity sliding vane in the variable-capacity cylinder assembly due to the pressure difference between the head portion and the tail portion of the variable-capacity sliding vane is sufficient to overcome the magnetic force applied by the magnetic element on the variable-capacity sliding vane, the pressure difference between the head portion and the tail portion of the variable-capacity sliding vane being the second pressure difference;

causing the variable-capacity sliding vane to be freed from a restraint of the magnetic element, and causing the variable-capacity sliding vane to move toward the roller of the compressor under the action of the gas force until the variable-capacity sliding vane fits the roller, such that a space in the variable-capacity assembly is divided into a space on an intake side and a space on an exhaust side;

continuously decreasing a pressure on a variable-capacity cylinder intake side of the variable-capacity cylinder, and gradually increasing a power of the compressor until the pressure on the variable-capacity cylinder intake side is equal to the pressure at the dispenser intake port of the dispenser in the compressor, causing the check valve in the variable-capacity assembly to turn on, then ending the switching process and causing the variable-capacity cylinder assembly to be in the working state;

or, when the sliding vane restraint unit comprises a sliding vane restraint hole restraint unit, the causing the variable-capacity cylinder assembly in the compressor to be in the working state or in the idling state comprises:

during the switching process of the variable-capacity cylinder assembly from the working state to the idling state:

gradually increasing the pressure on the variable-capacity cylinder intake side of the variable-capacity cylinder in the variable-capacity cylinder assembly through the variable-capacity assembly, until a frictional force generated by a sliding vane restraint hole on the variable-capacity sliding vane in the variable-capacity cylinder assembly is sufficient to overcome the gas force generated by the variable-capacity sliding vane due to the pressure difference, the pressure difference between the head portion and the tail portion of the variable-capacity sliding vane being a third pressure difference;

pushing the variable-capacity sliding vane into the variable-capacity cylinder sliding vane groove in the variable-capacity cylinder assembly, and restraining the variable-capacity sliding vane in the variable-capacity cylinder sliding vane groove through the frictional force; then continuously increasing the pressure on the variable-capacity cylinder intake side of the variable-capacity cylinder to be equal to the pressure in the housing, ending the switching process, the variable-capacity cylinder assembly being in the idling state;

or, during the switching process of the variable-capacity cylinder assembly from the idling state to the working state:

gradually decreasing the pressure inside the variable-capacity cylinder in the variable-capacity cylinder assembly through the variable-capacity assembly, until the pressure inside the variable-capacity cylinder is decreased to an extent such that the gas force generated by the variable-capacity sliding vane in the variable-capacity cylinder assembly due to the pressure difference between the head portion and the tail portion of the variable-capacity sliding vane is sufficient to overcome a frictional force on the variable-capacity sliding vane generated due to a high pressure introduced by the sliding vane restraint hole, the pressure difference between the head portion and the tail portion of the variable-capacity sliding vane being the third pressure difference;

causing the variable-capacity sliding vane to be freed from a restraint of the frictional force, and to move toward the roller in the compressor under an action of the gas force generated by the variable-capacity sliding vane due to the pressure difference between the head portion and the tail portion of the variable-capacity sliding vane, until the variable-capacity sliding vane fits the roller, the space in the variable-capacity assembly being divided into a space on an intake side and a space on an exhaust side;

continuously decreasing the pressure on the variable-capacity cylinder intake side of the variable-capacity cylinder to gradually increase the power of the compressor, until the pressure on the variable-capacity cylinder intake side is equal to the pressure at the dispenser intake port of the dispenser in the compressor, causing the check valve in the variable-capacity assembly to turn on, ending the switching process, the variable-capacity cylinder assembly being in the working state.

* * * * *